US009125785B2

(12) United States Patent
Trees

(10) Patent No.: US 9,125,785 B2
(45) Date of Patent: Sep. 8, 2015

(54) PATIENT SUPPORT APPARATUSES WITH EXERCISE FUNCTIONALITIES

(71) Applicant: Hill-Rom Services, Inc., Batesville, IN (US)

(72) Inventor: Darin Trees, Montgomery, TX (US)

(73) Assignee: Hill-Rom Services, Inc., Batesville, IN (US)

( * ) Notice: Subject to any disclaimer, the term of this patent is extended or adjusted under 35 U.S.C. 154(b) by 90 days.

(21) Appl. No.: 14/039,927

(22) Filed: Sep. 27, 2013

(65) Prior Publication Data

US 2014/0073997 A1 Mar. 13, 2014

Related U.S. Application Data

(63) Continuation of application No. 12/959,251, filed on Dec. 2, 2010.

(60) Provisional application No. 61/284,178, filed on Dec. 14, 2009.

(51) Int. Cl.
*A63B 26/00* (2006.01)
*A61H 1/00* (2006.01)
(Continued)

(52) U.S. Cl.
CPC ..... *A61H 1/001* (2013.01); *A61G 7/005* (2013.01); *A61G 7/015* (2013.01); *A61G 7/16* (2013.01); *A63B 23/0405* (2013.01); *A61G 2007/0513* (2013.01); *A61G 2203/44* (2013.01);
(Continued)

(58) Field of Classification Search
USPC ..... 482/91–96, 131–132, 135, 142, 904; 601/24; 128/845; 5/81, 1 HS, 662
See application file for complete search history.

(56) References Cited

U.S. PATENT DOCUMENTS 238,799 A 3/1881 Morgan
1,018,757 A 2/1912 Grady
(Continued)

FOREIGN PATENT DOCUMENTS

CN 2730342 Y 10/2005
CN 201044780 Y 4/2008
(Continued)

OTHER PUBLICATIONS

International Search Report & Written Opinion mailed Mar. 3, 2014 relating to PCT/US2013/070326 filed Nov. 15, 2013; (10 Pages).
(Continued)

*Primary Examiner* — Oren Ginsberg
(74) *Attorney, Agent, or Firm* — Dinsmore & Shohl LLP

(57) ABSTRACT

A patient support apparatus generally includes a base frame and a support deck supported on the base frame, the support deck comprising a seat portion. A segmented patient support surface is slidably coupled to the support deck. A lift system is coupled to the support deck and the segmented patient support surface. The lift system raises, lowers and tilts the support deck with respect to the base frame, and pivots a torso support segment of the support surface with respect to a leg support segment of the support surface. A foot plate assembly is removably positioned proximate a free end of the support deck, the foot plate assembly receiving a patient's feet when a patient is positioned on the segmented patient support surface thereby enabling the patient to slide the segmented patient support surface relative to the support deck.

38 Claims, 18 Drawing Sheets

(51) Int. Cl.

| | |
|---|---|
| ***A61H 1/02*** | (2006.01) |
| ***A61H 5/00*** | (2006.01) |
| ***A61G 7/005*** | (2006.01) |
| ***A61G 7/015*** | (2006.01) |
| ***A61G 7/16*** | (2006.01) |
| ***A63B 23/04*** | (2006.01) |
| *A61G 7/05* | (2006.01) |
| *A63B 21/068* | (2006.01) |
| *A63B 21/16* | (2006.01) |
| *A63B 71/00* | (2006.01) |

(52) U.S. Cl.

CPC ..... *A63B21/068* (2013.01); *A63B 2021/1672* (2013.01); *A63B 2071/0018* (2013.01); *A63B 2208/0238* (2013.01)

(56) References Cited

U.S. PATENT DOCUMENTS

| | | | |
|---|---|---|---|
| 1,561,979 | A | 11/1925 | Gore |
| 1,735,569 | A | 11/1929 | Gregory |
| 2,598,204 | A | 5/1952 | Allen |
| 2,768,622 | A | 10/1956 | Sanders |
| 3,220,022 | A | 11/1965 | Nelson |
| 3,455,295 | A | 7/1969 | Kellogg |
| 3,527,202 | A | 9/1970 | Donzelle |
| 3,589,358 | A | 6/1971 | Megal |
| 3,741,200 | A | 6/1973 | Morin |
| 3,759,252 | A | 9/1973 | Berman |
| 3,760,801 | A | 9/1973 | Borgeas |
| 3,821,953 | A | 7/1974 | Mikan |
| 3,826,490 | A | 7/1974 | Mossman |
| 3,868,734 | A | 3/1975 | Benoit et al. |
| 3,887,180 | A | 6/1975 | Berman |
| 3,892,404 | A | 7/1975 | Martucci |
| 4,113,250 | A | 9/1978 | Davis |
| 4,169,591 | A | 10/1979 | Douglas |
| 4,378,791 | A | 4/1983 | Sarrell |
| 4,383,684 | A | 5/1983 | Schliep |
| 4,409,695 | A | 10/1983 | Johnston |
| 4,444,178 | A | 4/1984 | Kuo |
| 4,603,687 | A | 8/1986 | Greenwood |
| 4,615,335 | A | 10/1986 | Searcy |
| 4,620,704 | A | 11/1986 | Shifferaw |
| 4,638,793 | A | 1/1987 | Therkorn |
| 4,672,697 | A | 6/1987 | Schurch |
| 4,798,197 | A | 1/1989 | Nippoldt et al. |
| 4,825,852 | A | 5/1989 | Genovese et al. |
| 4,847,929 | A | 7/1989 | Pupovic |
| 4,867,143 | A | 9/1989 | Morin |
| 4,890,604 | A | 1/1990 | Nelson |
| 4,913,424 | A | 4/1990 | Pepin |
| 4,925,184 | A | 5/1990 | McJunkin, Jr. et al. |
| 4,928,957 | A | 5/1990 | Lanier et al. |
| 4,995,378 | A | 2/1991 | Dyer et al. |
| 5,005,829 | A | 4/1991 | Caruso |
| 5,024,214 | A | 6/1991 | Hayes |
| 5,098,089 | A | 3/1992 | Harrington et al. |
| 5,107,822 | A | 4/1992 | Ohashi |
| 5,125,884 | A | 6/1992 | Weber et al. |
| 5,153,959 | A | 10/1992 | Fitzsimmons |
| 5,169,363 | A | 12/1992 | Campanaro et al. |
| 5,181,289 | A | 1/1993 | Kassai |
| 5,207,628 | A | 5/1993 | Graham |
| 5,263,913 | A | 11/1993 | Boren |
| 5,402,544 | A | 4/1995 | Crawford et al. |
| 5,413,543 | A | 5/1995 | Drago |
| 5,454,126 | A | 10/1995 | Foster et al. |
| 5,479,666 | A | 1/1996 | Foster et al. |
| 5,551,937 | A | 9/1996 | Kwo |
| 5,577,279 | A | 11/1996 | Foster et al. |
| 5,601,519 | A | 2/1997 | Comereski |
| 5,662,591 | A | 9/1997 | Peindl et al. |
| 5,680,661 | A | 10/1997 | Foster et al. |
| 5,715,548 | A | 2/1998 | Weismiller et al. |
| 5,740,571 | A | 4/1998 | Tyra et al. |
| 5,810,698 | A | 9/1998 | Hullett et al. |
| 5,820,519 | A | 10/1998 | Slenker |
| 5,851,166 | A | 12/1998 | Bernardson |
| 5,860,941 | A | 1/1999 | Saringer et al. |
| D405,132 | S | 2/1999 | Westfall et al. |
| 5,885,197 | A | 3/1999 | Barton |
| 5,938,571 | A | 8/1999 | Stevens |
| 5,940,911 | A | 8/1999 | Wang |
| 5,967,955 | A | 10/1999 | Westfall et al. |
| 5,967,956 | A | 10/1999 | Teeter |
| 6,212,714 | B1 | 4/2001 | Allen et al. |
| 6,226,821 | B1 | 5/2001 | Heimbrock et al. |
| 6,241,642 | B1 | 6/2001 | Slenker |
| 6,243,897 | B1 | 6/2001 | Sumiya |
| 6,270,445 | B1 | 8/2001 | Dean, Jr. et al. |
| 6,371,894 | B1 | 4/2002 | Hill |
| 6,446,287 | B2 | 9/2002 | Borders |
| 6,464,296 | B1 | 10/2002 | Sumner |
| 6,611,979 | B2 | 9/2003 | Welling et al. |
| 6,645,130 | B2 | 11/2003 | Webber |
| 6,862,762 | B1 | 3/2005 | Johnson et al. |
| 6,910,236 | B2 | 6/2005 | René |
| 7,181,793 | B2 | 2/2007 | Lee |
| 7,416,518 | B2 * | 8/2008 | Cardinale ..... 482/92 |
| 7,426,760 | B2 | 9/2008 | Vrzalik |
| 7,481,751 | B1 | 1/2009 | Arnold |
| 7,597,656 | B2 | 10/2009 | Trees |
| 7,744,546 | B2 | 6/2010 | Lee |
| 7,874,971 | B2 | 1/2011 | Reyes |
| 7,883,444 | B1 | 2/2011 | Wu |
| 7,967,736 | B2 | 6/2011 | D'Silva et al. |
| 8,012,073 | B2 | 9/2011 | Barnett |
| 8,249,714 | B1 | 8/2012 | Hartman et al. |
| 8,640,285 | B2 | 2/2014 | Heimbrock et al. |
| 2004/0043876 | A1 | 3/2004 | Craciunescu |
| 2004/0221391 | A1 | 11/2004 | Allen et al. |
| 2007/0180621 | A1 | 8/2007 | Turner et al. |
| 2007/0203434 | A1 | 8/2007 | Namgung |
| 2008/0289108 | A1 | 11/2008 | Menkedick et al. |
| 2010/0005591 | A1 | 1/2010 | Manouchehri |
| 2010/0313358 | A1 | 12/2010 | Poyet |
| 2010/0313897 | A1 | 12/2010 | Schaeffer |
| 2011/0004996 | A1 | 1/2011 | Ryou et al. |
| 2011/0231997 | A1 | 9/2011 | Turner et al. |
| 2011/0251022 | A1 | 10/2011 | Lee |
| 2012/0066832 | A1 | 3/2012 | Poulos et al. |
| 2012/0073053 | A1 | 3/2012 | Turner et al. |
| 2012/0079655 | A1 | 4/2012 | Tekulve |
| 2012/0117730 | A1 | 5/2012 | Lemire et al. |

FOREIGN PATENT DOCUMENTS

| | | | |
|---|---|---|---|
| DE | 3736847 | A1 | 5/1989 |
| GB | 358890 | | 10/1931 |
| JP | 3692286 | B2 | 9/2005 |
| JP | 2007082877 | A | 4/2007 |
| KR | 100621350 | B1 | 9/2006 |
| KR | 2009094588 | A | 9/2009 |
| KR | 100942968 | B1 | 2/2010 |
| WO | 9807402 | A | 2/1998 |
| WO | 2009154372 | A | 12/2009 |
| WO | 2010057873 | A1 | 5/2010 |

OTHER PUBLICATIONS

Non-Final Office Action dated Mar. 18, 2013; U.S. Appl. No. 12/959,251, filed Dec. 2, 2010.

Notice of Allowance dated Jul. 17, 2013; U.S. Appl. No. 12/959,251, filed Dec. 2, 2010.

International Search Report and Written Opinion of the International Searching Authority mailed Aug. 23, 2011; PCT/US2010/058786 filed Dec. 2, 2010.

International Search Report & Written Opinion mailed Mar. 16, 2015 relating to PCT/US2014/070873 filed Dec. 17, 2014.

(56) References Cited

OTHER PUBLICATIONS

Non-Final Office Action mailed Jan. 28, 2015 relating to U.S. Appl. No. 14/155,794, filed Jan. 15, 2014.

Non-Final Office Action mailed Oct. 7, 2014 relating to U.S. Appl. No. 14/155,787, filed Jan. 15, 2014.

Notice of Allowance mailed Jan. 20, 2015 relating to U.S. Appl. No. 14/155,787, filed Jan. 15, 2014.

* cited by examiner

PATIENT SUPPORT APPARATUSES WITH EXERCISE FUNCTIONALITIES

CROSS REFERENCE TO RELATED APPLICATIONS

The present specification is a continuation of U.S. patent application Ser. No. 12/959,251 entitled "HOSPITAL BED WITH CHAIR EGRESS, TILT TABLE, AND LEG PRESS FUNCTIONS," which claims priority to U.S. Provisional Application Ser. No. 61/284,178 filed Dec. 14, 2009 and entitled "HOSPITAL BED WITH CHAIR EGRESS, TILT TABLE, AND LEG PRESS FUNCTIONS," the entirety of which is incorporated herein by reference.

TECHNICAL FIELD

The present specification generally relates to patient support apparatuses and, more specifically, to patient support apparatuses which are adjustable from a horizontal orientation to an egress orientation, a tilt orientation, and an exercise orientation useful for rehabilitating patients with severe muscle weakness.

BACKGROUND

Recent medical advances have allowed more patients to survive serious injuries or disease processes than ever before. Unfortunately, the period of bed rest required for recovery often leads to severe deterioration of muscle strength and a corresponding inability of the patient to support full body weight upon standing. It is challenging for rehabilitation specialists to help these patients regain the ability to stand and begin ambulation, and the challenge is especially great for obese patients. A common technique in conventional practice is to summon as many colleagues as practical to lift and maneuver the weakened patient to a standing position while he or she attempts to bear full weight through the lower extremities. This technique is not only dangerous, because of the risk of a fall, but it is also psychologically degrading for the patient as the activity reinforces the patient's dependence on others.

Hospital beds have evolved over the years from conventional beds that lie flat to beds that convert into a chair position, allowing patients to begin standing from the foot of the bed. Examples of these beds are the Total Care bed by Hill-Rom (Batesville, Ind.) and the BariKare bed by Kinetic Concepts Incorporated (San Antonio, Tex.). Although this advancement in hospital bed design allows patients to sit upright and egress from the foot end of the bed, it is still a passive event requiring no effort by the patient. The sitting position does not improve a patient's leg strength and does little for preparing a patient for upright standing. Patients are still required to be lifted by hospital staff as the patient's leg muscles do not have adequate strength to support their weight.

An alternative to mobilizing patients with manpower is to use a tilt table. A tilt table resembles a stretcher that can be tilted gradually from a horizontal to a vertical position. The patient is transferred laterally from a hospital bed to the tilt table surface and secured to the tilt table with straps placed across the knees and waist. The table's surface is then tilted to the desired inclination. A footboard at the lower end prevents the patient from sliding off the table and allows graded weight-bearing through the legs. The benefits of tilt table standing include a gradual retraining of the cardiovascular system to the demands of the body's upright position and the re-education of the balance mechanisms affected by long periods of bed rest.

Unfortunately, tilt tables have a significant limitation. The tilt table is only able to bring the patient to an upright position while simultaneously restricting movement of the lower extremities. This restriction prevents movement through the range-of-motion of the knee joints and greatly limits strengthening of the lower extremity muscles, because the legs are strapped to the table. The conventional tilt table design has no mechanism to enable a patient to perform lower or upper extremity exercise for strengthening or conditioning.

A recent advancement in rehabilitation of severely weak hospitalized patients is a therapeutic exercise device for hospitalized patients invented by this inventor (U.S. Pat. No. 7,597,656) and assigned to Encore Medical Asset Corporation (Henderson, Nev.). The exercise device, known as the Moveo XP, involves a sliding carriage on a portable base that allows patients to perform a leg press exercise using a portion of their body weight, depending on the incline of the table. This technique allows patients to begin partial-body-weight strengthening until they have adequate strength to begin standing.

Unfortunately, the Moveo XP has its limitations. Disadvantages with this device are that it requires additional storage space, is difficult to get into small hospital rooms, and can be difficult to transfer patients on and off the table, especially for patients of size. For example, the risk of staff injury during the transfer of a morbidly obese patient outweighs the potential benefit of a 15 to 20 minute workout on the table. Further, during these times of hospital staff cutbacks, assistance to perform the lateral transfers on and off the table is often times unavailable. Lastly, the device is not meant to function as a hospital bed as it does not have adequate cushioning, the ability to perform Trendelenburg with the head lower than the feet for patients with low blood pressure, and does not have side rails for patient safety.

Accordingly, a need exists for alternative patient support apparatuses, such as hospital beds and/or patient care beds which enable a patient to perform rehabilitation exercises.

SUMMARY

In one embodiment, a patient support apparatus with closed chain exercise functionalities includes a base frame and a support deck having a seat portion supported on the base frame. The patient support apparatus also includes a segmented patient support surface having a torso support segment and an upper leg support segment. The torso support segment and the upper leg support segment are slidably coupled to the support deck such that the torso support segment and the upper leg support segment are freely slidable with respect to the support deck. The torso support segment is also pivotable with respect to the upper leg support segment. A lift system is coupled to the support deck and the segmented patient support surface. The lift system raises, lowers and tilts the support deck with respect to the base frame, and pivots the torso support segment with respect to the upper leg support segment. A foot plate assembly is removably positioned proximate a free end of the support deck. The foot plate assembly receives the feet of a patient when the patient is positioned on the segmented patient support surface thereby enabling the patient to slide the segmented patient support surface relative to the support deck to perform a closed chain exercise.

In another embodiment, a patient support apparatus with closed chain exercise functionalities includes a base frame and a support deck supported on the base frame, the support deck comprising a seat portion. A segmented patient support surface is supported on the support deck and includes a torso support segment and an upper leg support segment, wherein the torso support segment is pivotable with respect to the upper leg support segment. A lift system is coupled to the support deck and the segmented patient support surface, the lift system raising, lowering and tilting the support deck with respect to the base frame, and pivoting the torso support segment with respect to the upper leg support segment. A stationary exercise support is positioned to be engaged by a patient when the patient is positioned on the segmented patient support surface such that the patient can perform a closed chain exercise while positioned on the segmented patient support surface.

In yet another embodiment, a patient support apparatus with closed chain exercise functionalities includes a base frame and a support deck supported on the base frame, the support deck includes a seat portion and a leg portion pivotally coupled to an end of the seat portion. A segmented patient support surface comprising an upper leg support segment is slidably coupled to the support deck such that the upper leg support segment is freely slidable with respect to the support deck. A lift system is coupled to the support deck and the segmented patient support surface, the lift system raising, lowering and tilting the support deck with respect to the base frame and pivoting the leg portion with respect to the seat portion. A foot plate assembly is removably positioned proximate a free end of the leg portion of the support deck, the foot plate assembly receiving the feet of a patient when the patient is positioned on the segmented patient support surface thereby enabling the patient to slide the segmented patient support surface relative to the support deck to perform a closed chain exercise.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
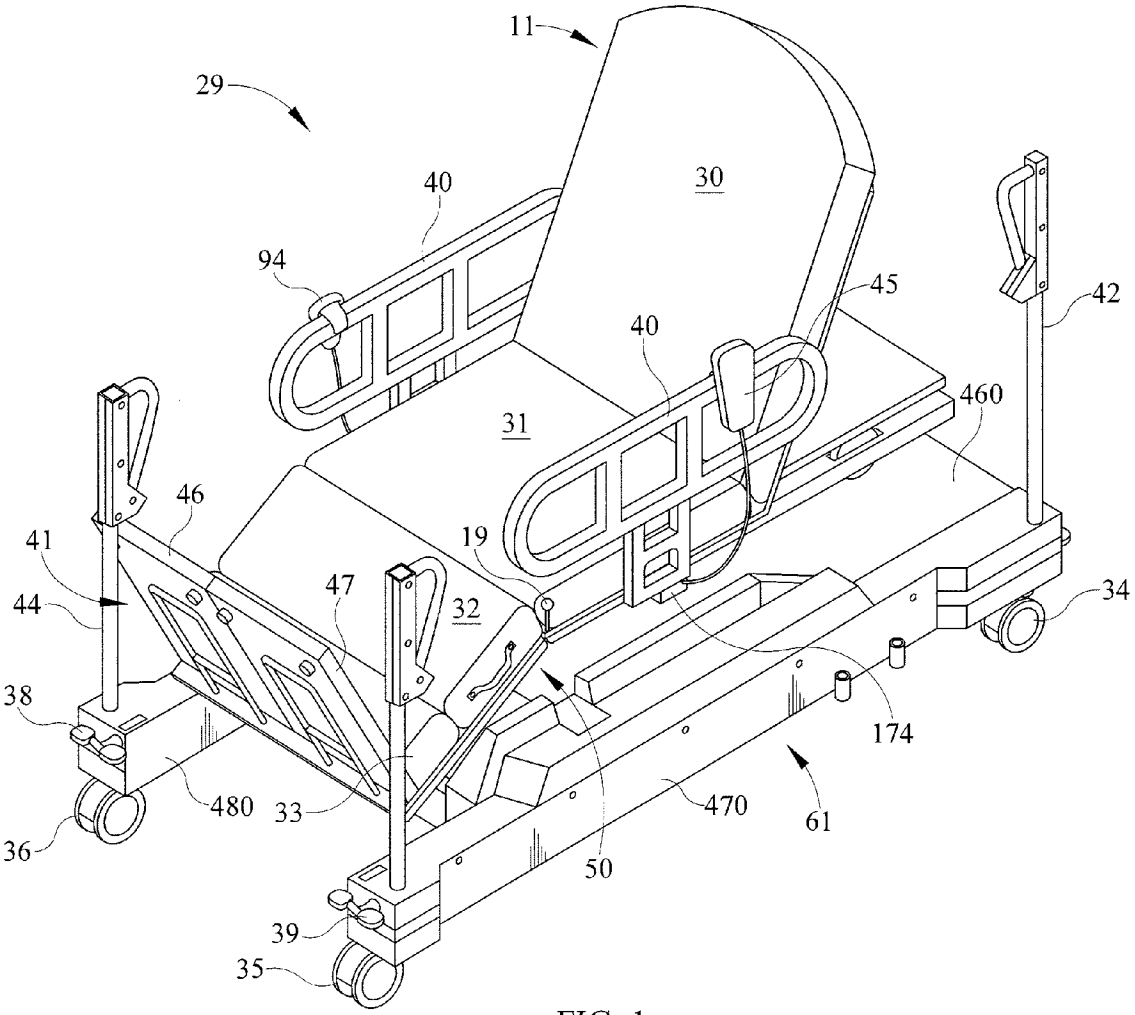
FIG. 1 shows a perspective view of a patient support apparatus according to one or more embodiments shown and described herein.

FIG. 1 generally depicts one embodiment of a patient support apparatus, such as a hospital bed, a patient care bed or the like, with closed-chain exercise functionalities. The patient support apparatus generally includes a base frame, a support deck, a segmented patient support surface, a lift system and a removable stationary exercise support. The support deck is mounted to the base frame such that the support deck can be raised, lowered and/or tilted relative to the base frame with the lift system. The segmented patient support surface is slidably coupled to the support deck such that the segmented patient support surface is freely slidable with respect to the support deck. The stationary exercise support is removably positioned on the support deck and is oriented to such that a patient can engage the stationary exercise support when the patient is positioned on the segmented patient support surface thereby enabling the patient to perform a closed chain exercise. The patient support apparatus and various features of the patient support apparatus will be described in more detail herein.

As used herein, the term "deconditioned" and similar terms refer to a condition of a person who, due to injury, disease or other circumstance, is in a weakened state. Such persons may suffer from lower extremity paralysis or an altered mental state, and may be unable to support their body weight in a standing position.

Referring to FIG. 1, one embodiment of a patient support apparatus 29 is schematically depicted. The patient support apparatus 29 can be used for rehabilitation of severely deconditioned patients, including deconditioned bariatric patients. The patient support apparatus 29 generally comprises a base frame 61, a support deck 50, a segmented patient support surface 11, a lift system 170 (depicted in FIGS. 4 and 5) and a stationary exercise support, such as foot plate assembly 41.

Figure 2:
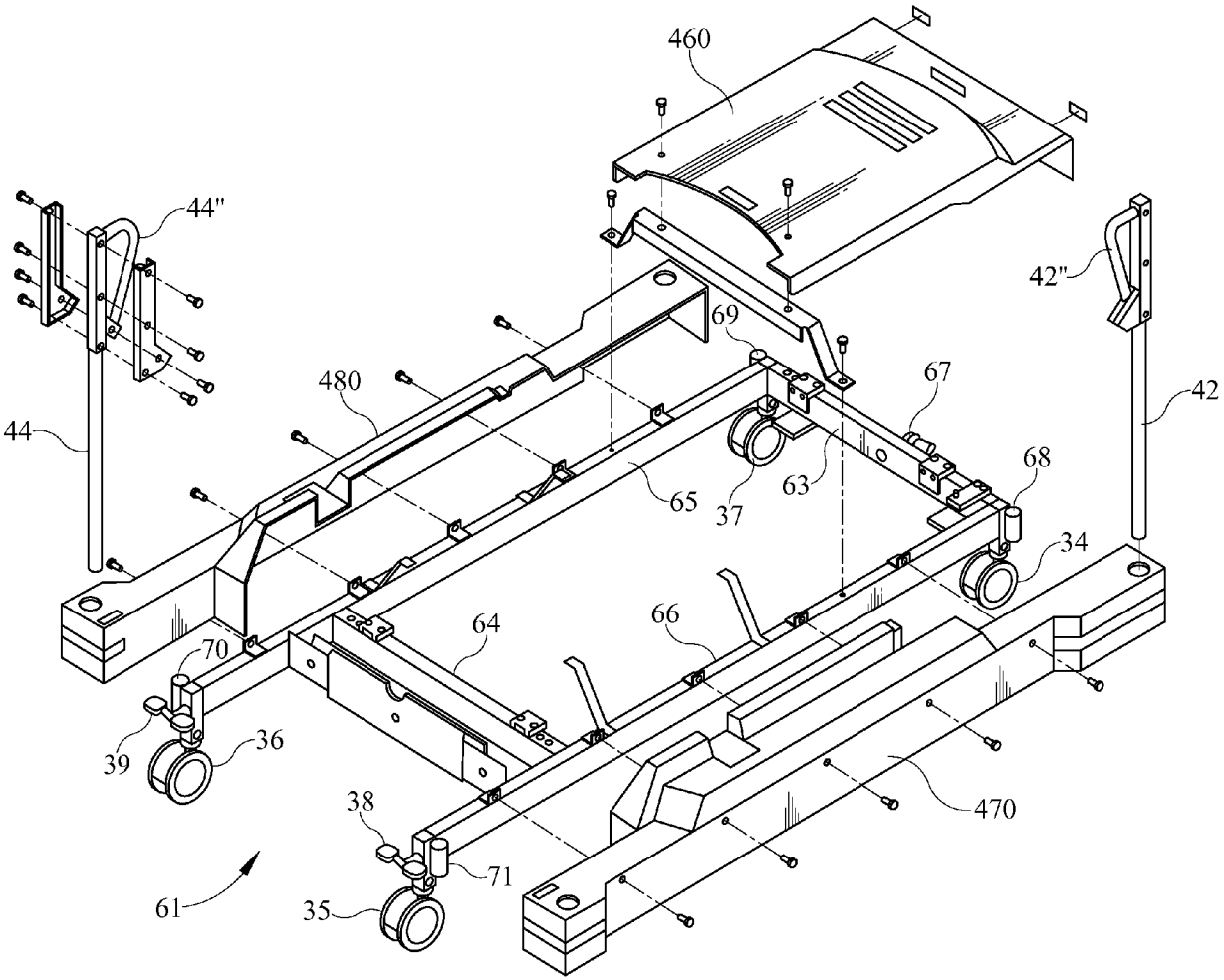
FIG. 2 is an exploded perspective view of the base frame and frame covers of the patient support apparatus of FIG. 1 according to one or more embodiments shown and described herein.
Figure 3:
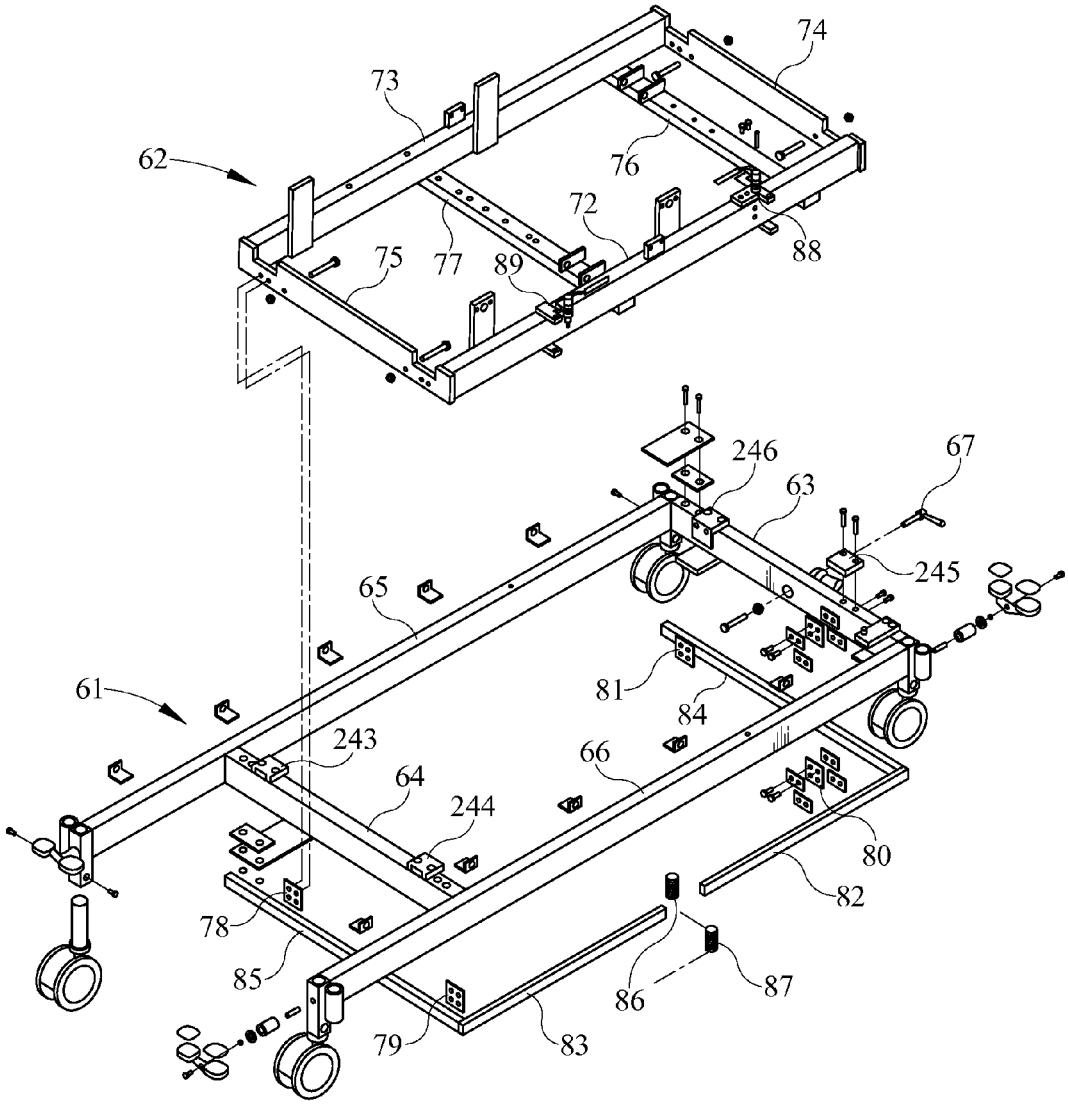
FIG. 3 is an exploded perspective view of the base frame, load frame and scale mechanism of the patient support apparatus of FIG. 1 according to one or more embodiments shown and described herein.

In one embodiment, the base frame 61 and the load frame 62 utilized may be similar to the base frame and load frame disclosed in U.S. Pat. No. 7,426,760. For example, referring to FIGS. 2-3, the description of which generally corresponds to FIGS. 3 and 4 of U.S. Pat. No. 7,426,760 and the associated description contained therein, the base frame 61 may generally comprise longitudinal beams 65 and 66 and transverse elements 63 and 64. Base frame 61 further comprises a plurality of casters 34, 35, 36, and 37 conventionally located proximate the four corners of the base frame 61. Locking mechanisms 38 and 39 are provided for at least the front casters 35, 36, respectively. However, it should be understood that the rear casters 34, 37 may be provided with similar locking mechanisms. The locking mechanisms may be set to prevent either rotation and/or steering of the casters 35, 36, thereby holding the base frame 61 (and patient support apparatus) stationary with respect to the floor, as is conventional with many hospital bed frames. A plurality of accessory weldments, such as accessory weldments 68, 69, 70 and 71 are attached to the base frame 61 on longitudinal beams 65, 66 (FIG. 2). In the embodiment of the base frame 61 depicted in FIGS. 2 and 3, the accessory weldments 68, 69, 70, 71 are attached proximate the ends of the longitudinal beams 65, 66. However, it should be understood that the accessory weldments may be attached at various locations along the longitudinal beams 65, 66 or even on the transverse elements 63, 64 of the base frame. The accessory weldments 68, 69, 70, 71 receive various attachments, such as stanchions 42, 44 on which various accessories may be supported, such as intravenous injection (IV) holders, standard traction frames, and the like. In the embodiments shown in FIGS. 1-3, stanchions 42, 44 include hand holds 42"-44" which may be used to facilitate patient entrance or exit from the patient support apparatus 29. However, in other embodiments described herein, accessory weldments 68, 69, 70, 71 may be used to receive various stationary exercise supports, such a upper extremity exercise assemblies, which may be used in conjunction with the patient support apparatus 29 to perform closed chain exercises to strengthen the upper and/or lower body of a patient, as will be described in more detail herein. The base frame 61 may further comprise one or more garnish covers 460, 470, 480 removably positioned over the various operating mechanisms of the patient support apparatus 29.

Referring now to FIGS. 1 and 3-5, the lift system 170 includes load frame 62 which couples the lift system 170 to the base frame 61. It is noted that FIGS. 3-5 and the following description generally correspond to FIGS. 4-5 of U.S. Pat. No. 7,426,760 and the associated description of those figures contained therein. The load frame 62 supports the various linear actuators (such as jack motors and the like) and related mechanical and electrical components which facilitate raising, lowering and tilting the support deck 50 with respect to the base frame 61 and articulating various portions and/or segments of both the support deck 50 and the segmented patient support surface 11. The load frame 62 generally comprises longitudinal beams 72, 73 and transverse elements 74, 75. Additional transverse elements 76, 77 support jack motors 90, 92, within the load frame 62, respectively. The operation of jack motors 90, 92 with respect to the operation of the patient support apparatus 29 will be described further herein.

In the embodiments described herein, linear variable displacement transducers (LVDTs) 88 and 89 are disposed between the load frame 62 and the base frame 61 such that any loads positioned on the load frame (i.e., a patient) is registered by the LVDTs which output a signal indicative of the load to the control unit 174. For example, in one embodiment, the load frame 62 and base frame 61 are coupled as described in U.S. Pat. No. 4,793,428, which is herein incorporated by reference. In particular, the base frame 61 includes a pair of displacement transmitting members 84, 85 which are respectively connected between transverse elements 63 and 74 and 64 and 75 with flexures 78, 79, 80 and 81 and 243, 244, 245 and 246. More specifically, transmitting member 84 is attached to transverse element 63 with flexure 246 and transverse element 74 with flexure 81. Bar elements 82, 83 are connected to members 84 and 85 in a cantilevered manner such that, when a load is applied to the load frame 62, the load is communicated to the bar elements 82, 83 through the transmitting members and flexures. The displacement of the bar elements 82, 83 is limited by springs 86, 87. The displacement of the bar elements 82, 83 is measured with the LVDTs 88, 89 which output a signal in direct proportion to the weight of the load frame, and all which is supported thereon, to control unit 174. The load frame 62 further comprises a locking mechanism 67 which secures the load frame 62 to the base frame 61 during transport of patient support apparatus 29.

Referring now to FIGS. 1, 3-5 and 7, the mechanical and electrical mechanism which facilitate raising, lowering and tilting the support deck 50 relative to the base frame 61 are schematically depicted. Tilting of the support deck 50 relative to the base frame 61 may also be referred to herein as orienting the support deck in a Trendelenburg orientation or a reverse Trendelenburg orientation. In a Trendelenburg orientation, a head of the support deck 50 is lower than a foot of the support deck 50 while in a reverse Trendelenburg orientation, the foot of the support deck 50 is lower that the head of the support deck. To facilitate raising, lowering and tilting the support deck 50 relative to the base frame, the load frame 62 includes a head torque arm 106 and foot torque arm 110, each of which are pivotally attached to load frame 62. A deck frame 150, to which the support deck 50 is pivotally attached, is coupled to the head torque arm 106 and the foot torque arm 110 with linkage members 102, 105, 108, and 109. Specifically, the foot torque arm 110 is pivotally connected to linkage members 108, 109 at locations 101, 107, respectively, using bushings and other conventional hardware. The head torque arm 106 is mechanically coupled to jack motor 90 with jack sleeve 91 such that, when the jack motor 90 is actuated, the rotation of the jack motor 90 is translated to the head torque arm 106 through the jack sleeve 91 thereby rotating the head torque arm 106 about pivots 106' and 106". Similarly, the foot torque arm 110 is mechanically coupled to jack motor 92 with jack sleeve 93 such that, when the jack motor 92 is actuated, the rotation of the jack motor 92 is translated to the foot torque arm 110 through the jack sleeve 93 thereby rotating the foot torque arm 110 about pivots 110' and 110". In the embodiments described herein, the jack motors 90, 92 and corresponding jack sleeves 91, 93 may be linear actuators, such as linear actuators produced by Linak, or any other similar linear actuator. The jack motors 90, 92 are attached to the transverse members 76, 77 of load frame 62 with torque arm pins 95, 97 affixed by cotter pins 96 and 98.

Extension of the jack sleeve 93 by jack motor 92 causes the foot torque arm 110 to pivot relative to load frame 62. The rotation of the foot torque arm 110, relative to the load frame 62 articulates the linkage members 108, 109 either upward or downward, depending on the direction of rotation of the jack motor 92. Likewise, extension of the jack sleeve 91 by jack motor 90 causes head torque arm 106 to pivot relative to the load frame 62 and articulates the linkage members 102 and 105 either upward or downward, depending on the rotation of the jack motor 90. Articulation of the linkage members 102, 105, 108 and 109 raises, lowers and/or tilts the support deck 50 with respect to the base frame 61.

In embodiments where the linkage members 102, 105, 108 and 109 are uniformly raised by jack motors 90, 92 (i.e., the "BED UP" function of the control pendant, described further herein), the head and foot of the support deck 50 are uniformly raised. Similarly, in embodiments where the linkage members 102, 105, 108 and 109 are uniformly lowered by jack motors 90, 92 (i.e., the "BED DOWN" function of the control pendant, described further herein), the head and foot of the support deck 50 are uniformly lowered.

Embodiments where one jack motor is rotated to a greater or lesser extent than the other results in the support deck being positioned in either a Trendelenburg orientation or a reverse Trendelenburg orientation, as described above. In some embodiments described herein, the lift system 170 is capable of positioning the support deck at about a ten degrees Trendelenburg orientation and/or about twelve and one half degrees of reverse Trendelenburg orientation. The Trendelenburg and reverse Trendelenburg orientations may be achieved utilizing the TRENDELENBURG or REVERSE TRENDELENBURG functions of the control pendants, as will be described in more detail herein.

Figure 4:
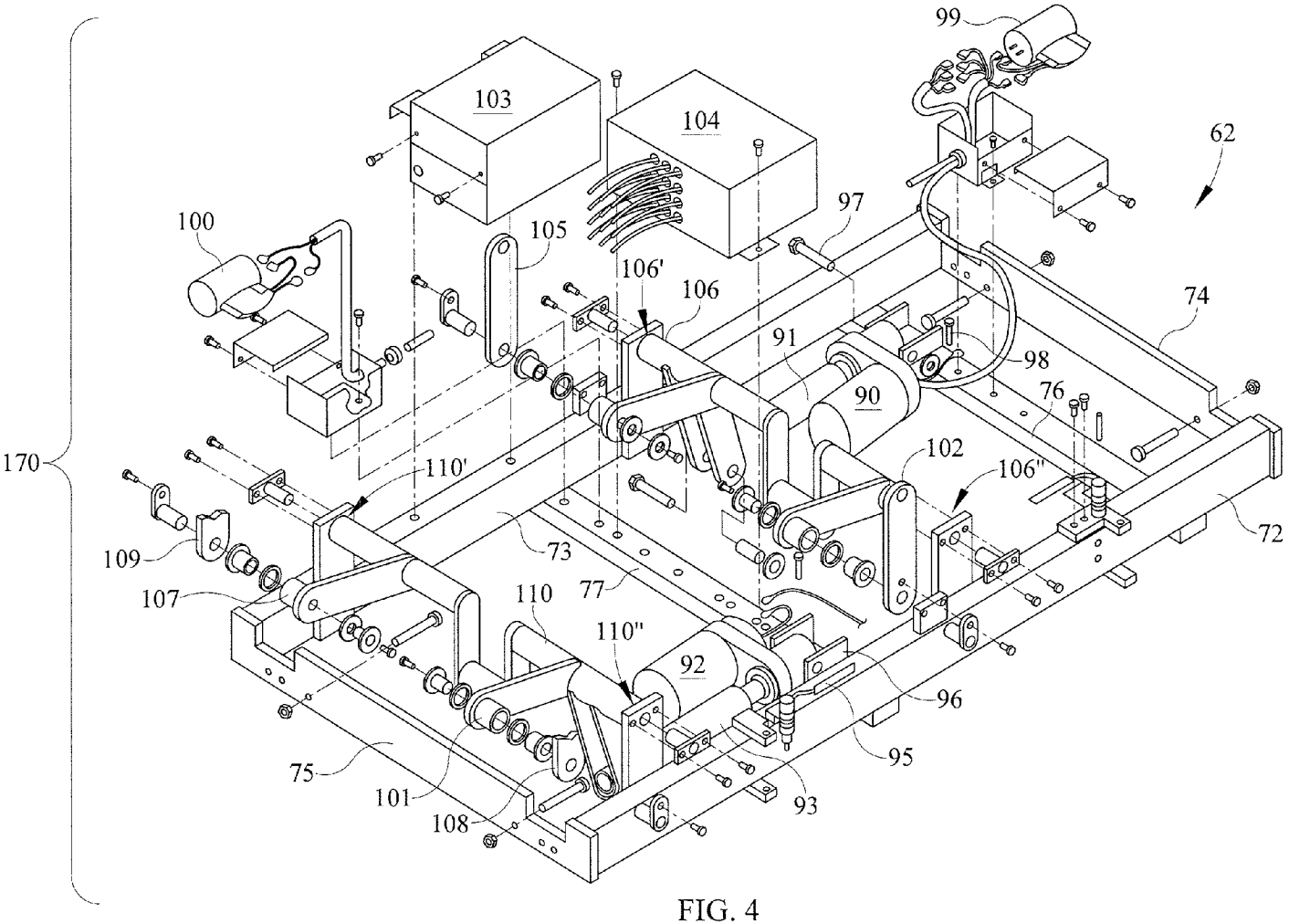
FIG. 4 is an exploded perspective view of the load frame of the patient support apparatus of FIG. 1 according to one or more embodiments described herein.

Referring to FIG. 4, the load frame 62 also contains various electronic components of the lift system 170. For example, the load frame 62 may also contain the transformer assembly 103 and junction box assembly 104 through which power is supplied to the various jack motors of the lift system 170. Additionally, inductor-capacitor-resistor (LRC) networks 99 and 100 can be mounted on the load frame 62 so as to conserve space within the junction box assembly 104. LRC networks 99 and 100 are used for the capacitive startup of jack motors 90 and 92 and to protect the power distribution system and control system of the patient support apparatus 29 from back electromotive forces (EMF) generated at initial startup of either jack motor 90 or 92.

While specific mechanisms (i.e., the load frame, jack motors, etc.) for raising, lowering and tilting the support deck of the patient support apparatus have been described herein as being similar to the base frame and load frame described in U.S. Pat. No. 7,426,760, it should be understood that these mechanisms are exemplary and that it is contemplated that other mechanisms for raising, lowering and tilting the support deck of the patient support apparatus are contemplated. Accordingly, it should be understood that the support deck, carriage, and segmented patient support surface described herein can be adapted for use with various other raising, lowering and tilting mechanisms used in commercially available hospital and patient care beds including, without limitation, the Total Care series of beds manufactured by Hill-Rom of Batesville, Ind. and the BariKare series of beds manufactured by Kinetic Concepts Incorporated of San Antonio, Tex.

Figure 6:
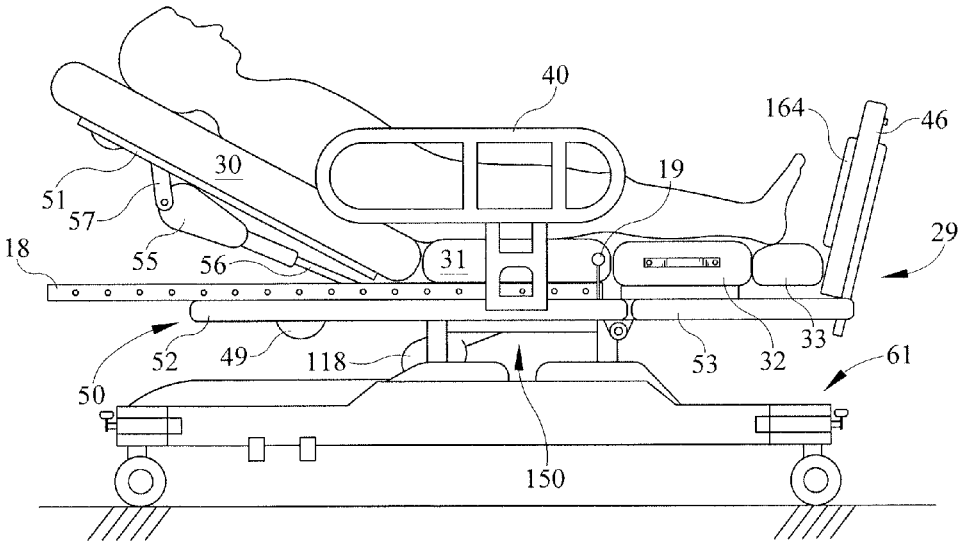
FIG. 6 is a side view of the patient support apparatus of FIG. 1 with the head cushion in an inclined position according to one or more embodiments shown and described herein.
Figure 8:
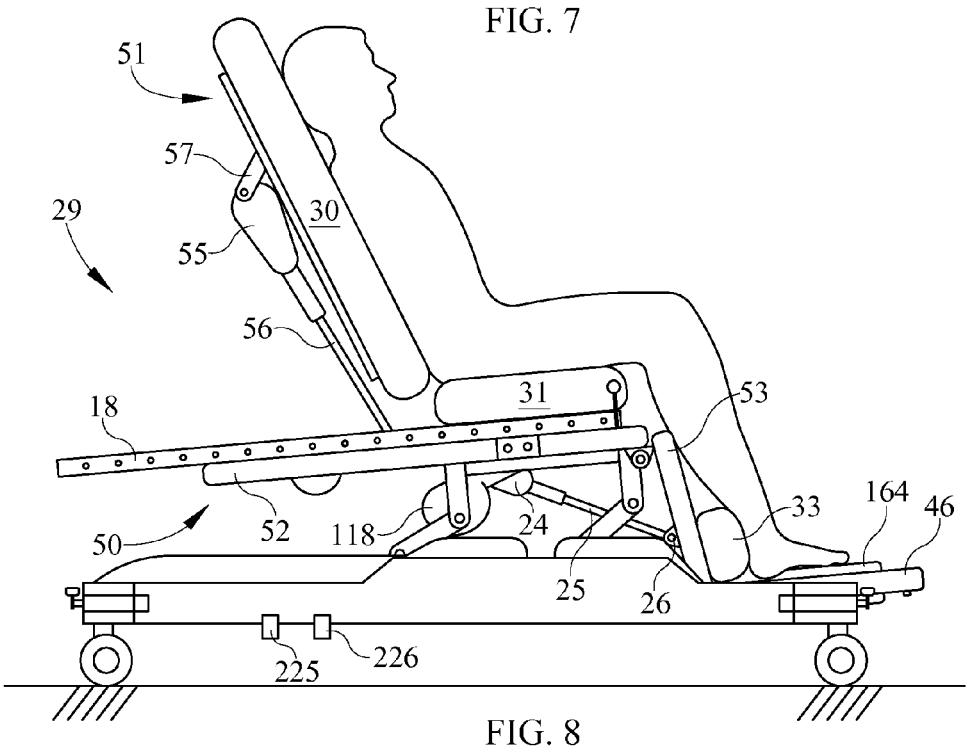
FIG. 8 is a side view of the patient support apparatus of FIG. 1 configured in the reclined chair orientation according to one or more embodiments shown and described herein.
Figure 14A:
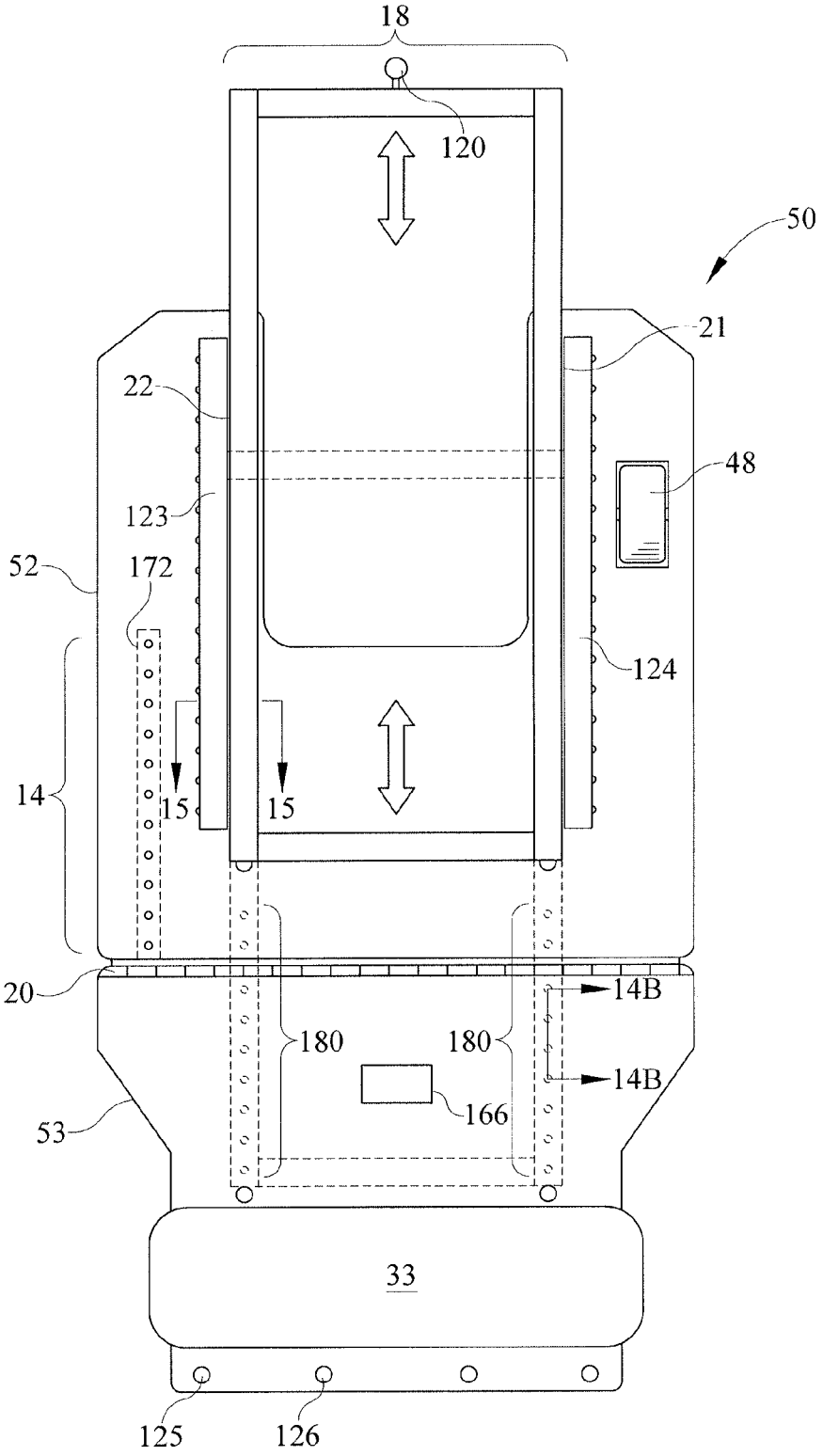
FIG. 14A is a top view of a portion of the patient support apparatus of FIG. 1 showing the telescopic linear rails according to one or more embodiments shown and described herein.

Referring now to FIGS. 6 and 14A, the support deck 50 of the patient support apparatus 29 generally comprises at least a seat portion 52. In the embodiments of the support deck 50 depicted in FIGS. 6 and 14A, the support deck 50 further comprises a leg portion 53 which is pivotally coupled to an end of the seat portion 52 with hinge 20. The hinge 20 facilitates pivoting the leg portion 53 of the support deck 50 with respect to the seat portion 52 of the support deck 50 such that the leg portion is positionable between an aligned position wherein the leg portion 53 is substantially coplanar with the seat portion 52 (as shown in FIG. 6) and at least one declined position wherein the leg portion 53 is oriented at a downward angle with respect to the seat portion 52 such that the leg portion 53 is non-coplanar with the seat portion 52 (as shown in FIG. 8).

Figure 5:
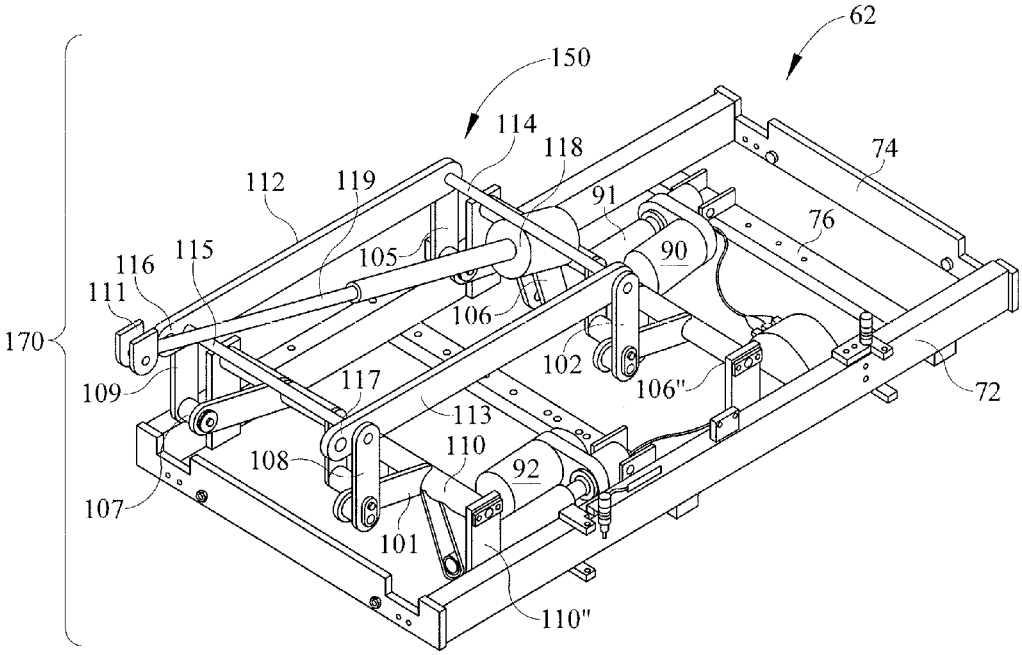
FIG. 5 is a perspective view of the load frame of FIG. 4 according to one or more embodiments shown and described herein.
Figure 7:
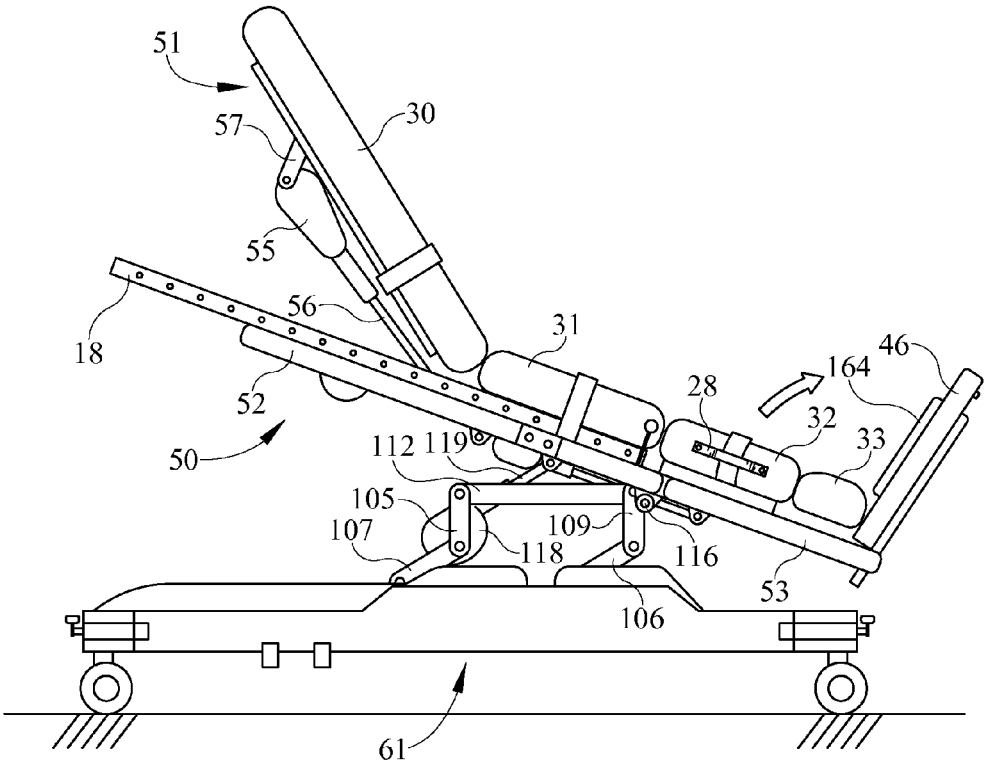
FIG. 7 is a side view of the patient support apparatus of FIG. 1 with the head assembly inclined with respect to the base frame and the head cushion inclined with respect to the head assembly according to one or more embodiments shown and described herein.

Referring to FIGS. 5-7, the support deck 50 is pivotally coupled to the deck frame 150 of the lift system 170 such that the support deck 50 can be tilted with respect to the base frame 61, as depicted in FIG. 7. For example, in the embodiments of the patient support apparatus 29 described herein, the deck frame 150 of the lift system 170 includes a pair of transverse members 114, 115 coupled to a pair of longitudinal members 112, 113. The longitudinal members 112, 113 and transverse members 114, 115 are connected to linkage members 102, 105, 108 and 109 which stabilize deck frame 150. The deck frame 150 further comprises bearing pivots 116, 117 positioned at the front (i.e., the foot end) of the deck frame 150. The bearing pivots 116, 117 are pivotally coupled to the seat portion 52 of the support deck 50 such that the entire support deck 50 can be tilted to a tilt angle relative to the base frame 61. In one embodiment, the tilt angle is less than or equal to 90 degrees. In another embodiment, the tilt angle is less than or equal to eighty-five degrees. Tilt jack motor 118 is located between weldments to linkage members 102 and 105 and directly positioned on transverse member 114 of the deck frame 150. The jack sleeve 119 of the tilt jack motor 118 is pivotally coupled to the underside of the seat portion 52 of the support deck 50 with a connecting yoke 111 located on the end of the jack sleeve 119. The tilt jack motor 118 tilts the support deck 50 relative to the base frame 61 by extending and retracting the jack sleeve 119 relative to the load frame 62, as will be described in further detail herein.

As noted hereinabove, the leg portion 53 of the support deck 50 is pivotable relative to the seat portion 52. In order to facilitate controlled, automated pivoting of the leg portion 53 of the support deck 50, the lift system 170 further comprises a decline jack motor 24. Referring to FIG. 8, the decline jack motor 24 is attached to the underside of the seat portion 52 of the support deck 50. Decline jack motor 24 is pivotally attached to the leg portion 53 of the support deck 50 with attachment yoke 26 which is positioned on the end of decline jack sleeve 25. Rotation of the decline jack motor 24 either extends or retracts the decline jack sleeve 25 with respect to the seat portion 52 depending on the direction of rotation of the decline jack motor 24. When the decline jack sleeve 25 is retracted, the leg portion 53 of the support deck 50 is pivoted downwards, to one or more declined positions. However, when the decline jack sleeve 25 is extended, the leg portion of the support deck 50 is pivoted upwards, until the jack sleeve is substantially coplanar with the seat portion 52, as described above. In the embodiments described herein, the leg portion 53 of the support deck 50 is pivotal from the aligned position up to a decline angle of about 90 degrees with respect to the seat portion 52. Pivoting of the leg portion 53 of the support deck 50 with the decline jack motor 24 may be accomplished using a LEGS UP function or a LEGS DOWN function of a control pendant, as will be described in more detail herein.

Referring now to FIGS. 1, 6 and 7, the segmented patient support surface 11 generally comprises a torso support segment 30 and an upper leg support segment 31 which are attached to the seat portion 52 of the support deck 50. The segmented patient support surface 11 may optionally comprise a lower leg support segment 32 and an ankle support segment 33 attached to the leg portion 53 of the support deck 50. In embodiments where the segmented patient support surface 11 comprises a lower leg support segment 32, the lower leg support segment 32 is removably attached to the lower leg portion, such as with hook and loop closures, straps, snaps, or any other suitable fastener or fastener system. The lower leg support segment 32 may include handles 28 (one shown in FIG. 7) located on both sides to allow removal of lower leg support segment 32 from the leg portion 53. Removing the lower leg support segment 32 facilitates the exercise, chair and egress functions of the patient support apparatus 29, as will be discussed further herein. In the embodiments described herein, the segments 30, 31, 32, 33 of the segmented patient support surface 11 generally comprise a synthetic cover material which is filled with a support material, such as foam, synthetic fibers, natural fibers or the like. Alternatively, the segments may have a traditional mattress structure which incorporates springs and/or combinations of springs with other support materials.

Figure 15:
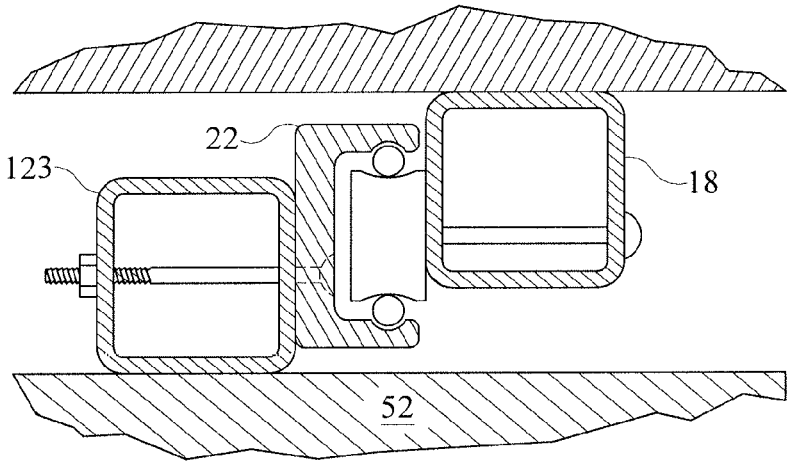
FIG. 15 is a cross-sectional view of the telescopic linear rails of the carriage according to one or more embodiments shown and described herein.

Referring to FIGS. 6, 14A and 15, the torso support segment 30 and the upper leg support segment 31 of the segmented patient support surface 11 are slidably coupled to the support deck 50 such that the torso support segment 30 and the upper leg support segment 31 are freely slidable with respect to the support deck 50. For example, in the embodiments described herein, the torso support segment 30 and the upper leg support segment 31 are attached to a carriage 18. The carriage 18 is mounted to a pair of spaced longitudinal beams 123, 124 attached to the top surface of the seat portion 52 of the support deck 50 with sliding rails 21, 22 disposed between the spaced longitudinal beams 123, 124 and the carriage 18 such that the carriage 18 (and therefore torso support segment 30 and the upper leg support segment 31) is slidable with respect to the support deck 50 (i.e., the sliding rails 21, 22 slidably couple the carriage 18 to the spaced longitudinal beams 123, 124). The carriage 18, torso support segment 30 and upper leg support segment 31 are generally slidable between a head of the support deck 50 and a foot of the support deck 50.

As noted hereinabove, the support deck 50 comprises a seat portion 52 and a leg portion 53 which is pivotable with respect to the seat portion 52 about a hinge 20. The location of the hinge 20 prevents the use of conventional, fixed sliding rails which would be affixed to both the seat portion 52 and the leg portion 53 thereby extending over the hinge 20 and preventing the leg portion 53 from pivoting with respect to the seat portion 52. To overcome this impediment, in some embodiments, the sliding rails 21, 22 are telescoping sliding rails which are fixedly attached to the spaced longitudinal beams 123, 124 on the seat portion 52 of the support deck 50. In these embodiments, the sliding rails 21, 22 have an extended position where the sliding rails 21, 22 are positioned over at least a portion of the support deck 50 (as shown in dashed lines in FIG. 14A) and a retracted position, where the sliding rails 21, 22 are not positioned over the leg portion 53 of the support deck 50. In embodiments where the sliding rails are telescoping sliding rails, the sliding rails may be model no. SR28-770 or SR 43-770 ball semi-telescopic rail slides manufactured by Linear Trace SRL (Cinisello, Italy). However, it should be understood that other, similar telescoping sliding rails may be used.

Figure 13:
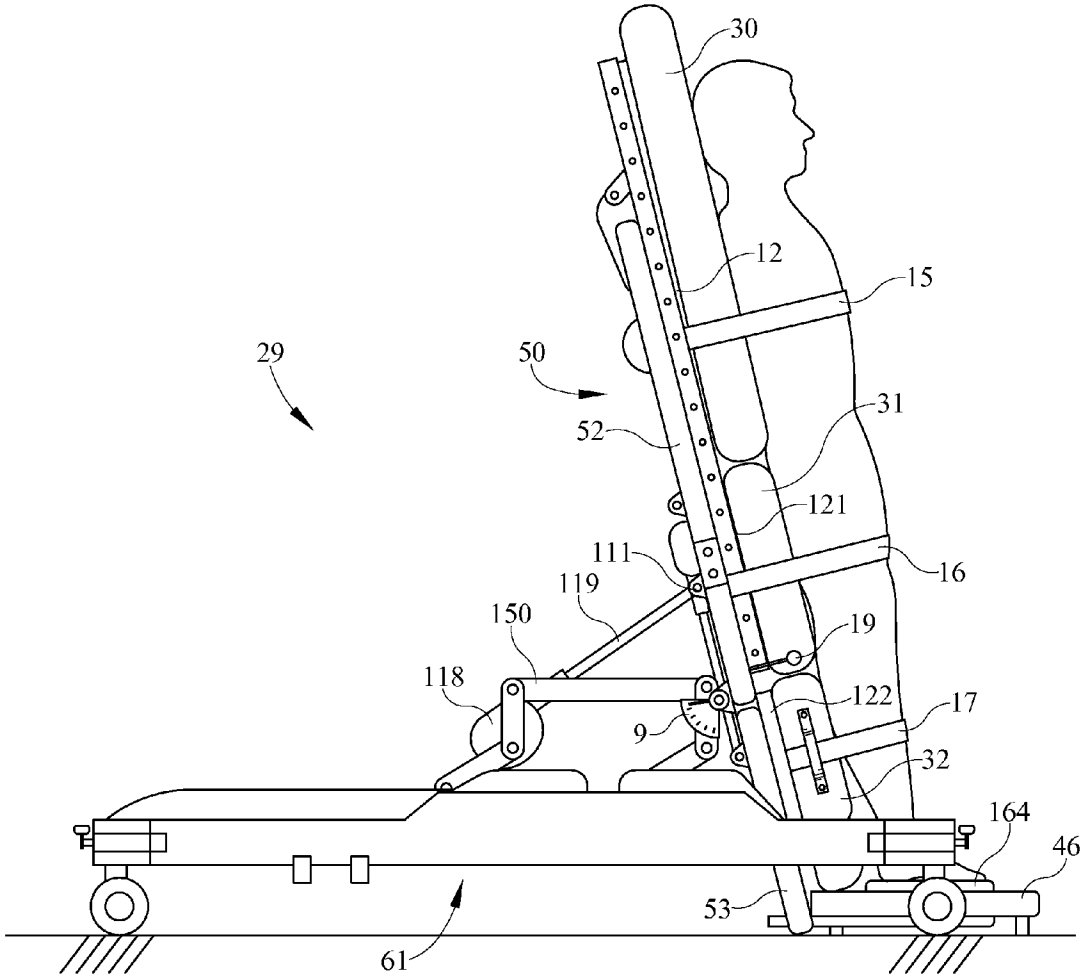
FIG. 13 is a side view of the patient support apparatus of FIG. 1 showing use of the tilt orientation by a patient restrained with various body straps.
Figure 16:
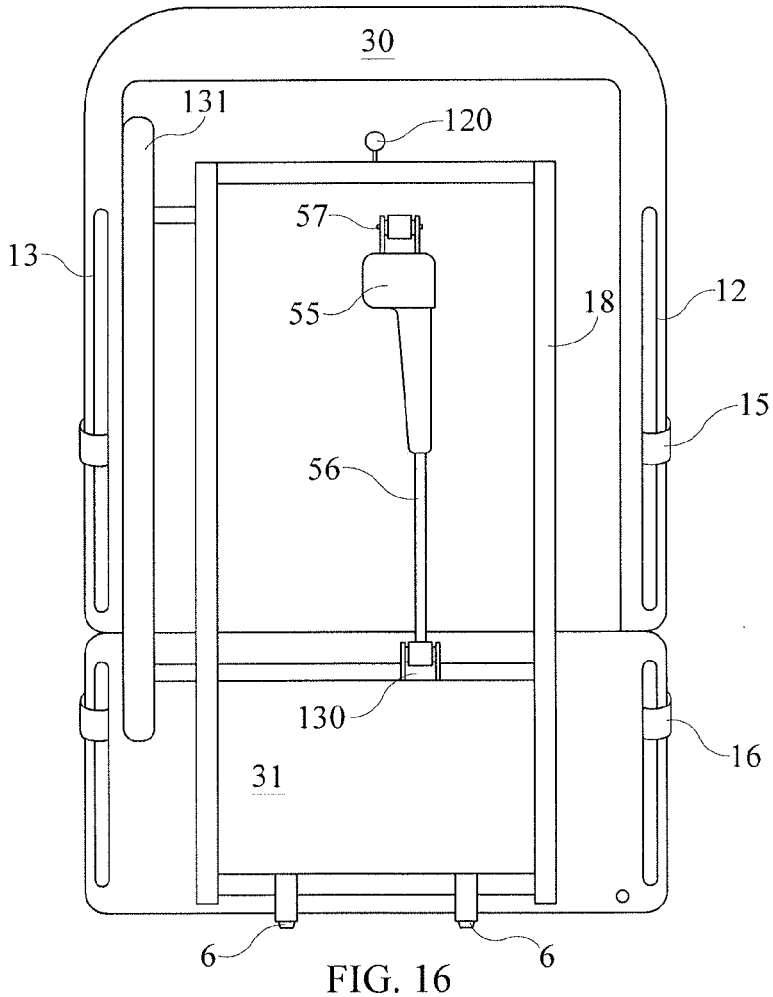
FIG. 16 is a bottom view of the carriage of the patient support apparatus of FIG. 1 according to one or more embodiments shown and described herein.

Referring to FIGS. 6 and 16, the torso support segment 30 of the segmented patient support surface 11 is pivotable with respect to the upper leg support surface 31 such that the torso support segment 30 is positionable with respect to the upper leg support segment 31 from a recumbent position, wherein the torso support segment and the upper leg support segment are substantially coplanar (as depicted in FIG. 13), and at least one inclined position, wherein the torso support segment is non-coplanar with the upper leg support segment (as depicted in FIG. 6). In order to facilitate automated pivoting of the torso support segment 30 with respect to the upper leg support segment 31, the patient support apparatus 29 may include an incline jack motor 55. In one embodiment, the torso support segment 30 is fixedly attached to a head frame 51. In this embodiment, the incline jack motor 55 is pivotally coupled to the underside of the head frame 51 with coupling yoke 57. Similarly, the incline jack sleeve 56 of the incline jack motor 55 is pivotally coupled to a cross support 130 of the carriage 18. Accordingly, extending the incline jack sleeve 56 with the incline jack motor 55 pivots the torso support segment 30 to at least one inclined position with respect to the upper leg support segment 31 while retracting the incline jack sleeve 56 with the incline jack motor 55 pivots the torso support segment 30 to the recumbent position with respect to the upper leg support segment 31.

Referring again to FIGS. 6, 14A, 16 and 19, in some embodiments, the patient support apparatus 29 may further comprise an adjustable brake assembly 49 mounted on the support deck 50 and engaged with the carriage 18. The adjustable brake assembly 49 assists in preventing the rapid acceleration of the carriage 18 with respect to the support deck 50, particularly when the support deck 50 is inclined with respect to the base frame 61. Accordingly, it should be understood that the adjustable brake assembly is capable of regulating the rate of travel of the segmented patient support surface relative to the support deck. In the embodiments described herein, the adjustable brake assembly 49 comprises a centrifugal brake 48 which is mounted on a threaded post 204 attached to the seat portion 52 of the support deck 50. In the embodiments described herein, the centrifugal brake is a Flo-Guide™ speed controller (commonly referred to as a "pallet brake"), model E40, manufactured and sold by Mallard Manufacturing Corporation of Sterling, Ill. The centrifugal brake 48 is engaged with a wear element 131 attached to the carriage 18 such that, as the carriage 18 slides on the sliding rails 21, 22, the centrifugal brake 48 rolls over the wear element 131. When the carriage 18 is moving at a slow rate of speed, the centrifugal brake rolls freely under the carriage. However, when the carriage begins to increase speed, the centrifugal brake 48 resists the increase in speed and slows the carriage to a controlled speed. In the embodiments of the adjustable brake assembly 49 shown and described herein, the position of the centrifugal brake 48 is adjustable on the threaded post 204 by rotating knob 5 and thereby increasing or decreasing the frictional force between the centrifugal brake 48 and the wear element 131 and, as such, the stopping force of the centrifugal brake 48.

While the adjustable brake assembly 49 has been described herein as comprising a centrifugal brake 48, other forms of adjustable braking mechanisms are contemplated. For example, in other embodiments the adjustable braking mechanism may include an electro-magnetic braking device, an eddy current braking device, or any other suitable adjustable braking device.

Figure 20:
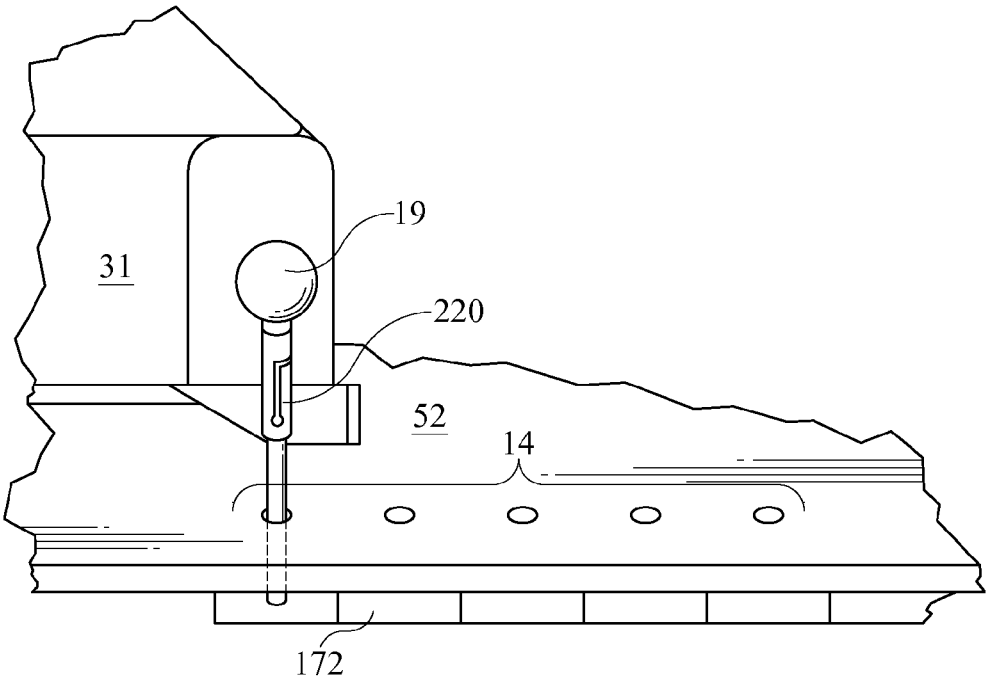
FIG. 20 is a perspective view of the locking mechanism on the carriage and range-of-motion stopping mechanism according to one or more embodiments shown and described herein.

Referring to FIGS. 6, 14A and 20, the carriage 18 can be releasably secured to the seat portion 52 of the support deck 50 with carriage lock mechanism 19. The carriage lock mechanism 19 comprises a retractable lock pin 220 that can be inserted into one of a plurality of apertures 14 formed in the seat portion 52 of the support deck 50. Lifting the retractable lock pin 220 and turning the pin counter-clockwise disengages the locking pin from the support deck 50, allowing free movement of the carriage. Turning the pin clockwise positions the pin 220 in an aperture 14 and secures the carriage to the support deck 50. In some embodiments, a lock pin sensor 172 is positioned on an underside of the seat portion 52 and detects when the retractable lock pin 220 is positioned in the one of the plurality of apertures 14. The lock sensor 172 may be a pressure sensor, a proximity sensor or any other sensor suitable for detecting the presence of the retractable lock pin 220 in an aperture. When the retractable lock pin 220 is not positioned in an aperture 14, the carriage 18 is free to slide relative to the support deck 50.

Figure 14B:
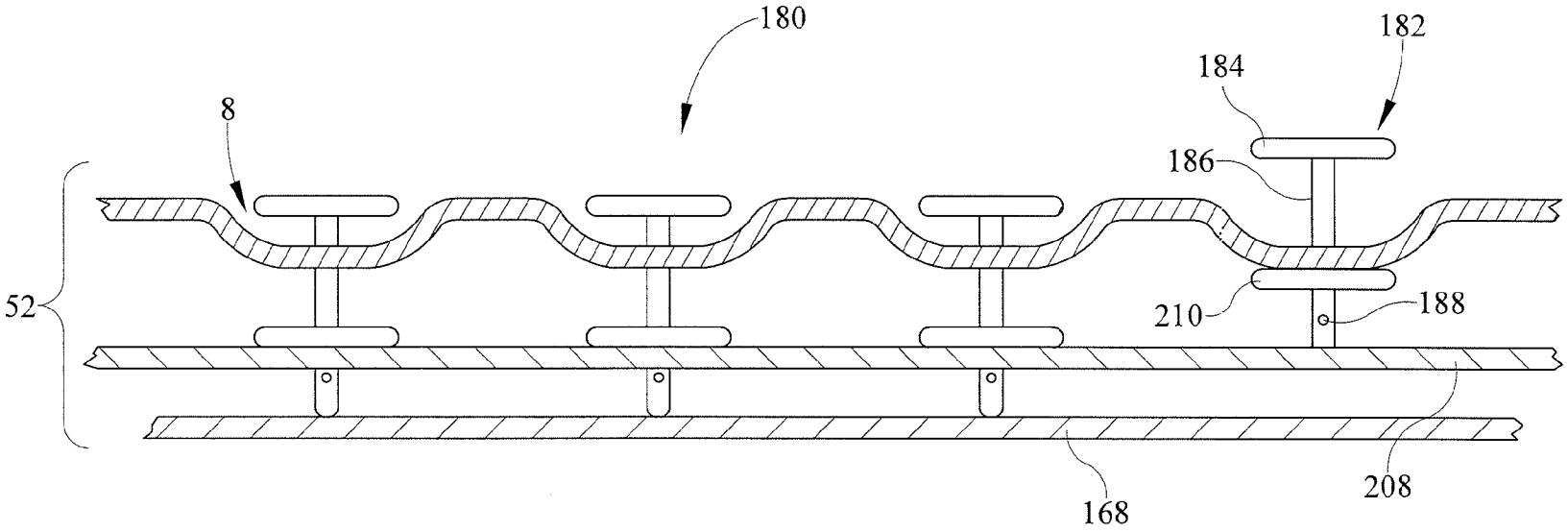
FIG. 14B schematically depicts a portion of a range of motion stop assembly according to one or more embodiments shown and described herein.

Referring to FIGS. 14A and 14B, the support deck 50 may also comprise a range of motion stop assembly 180. In the embodiment of the support deck 50 shown in FIGS. 14A and 14B, the range of motion stop assembly 180 includes a plurality of stop pins 182 positioned in apertures 8 formed in the seat portion 52 of the support deck 50. The apertures 8 and stop pins 182 are positioned in a path of travel of the carriage 18 such that, when a stop pin 182 is in a raised position, the stop pin 182 engages with the carriage thereby preventing the carriage 18 from further motion with respect to the support deck. The stop pins 182 comprise a head 184, a shaft 186, a retaining ball 188 disposed in the shaft, and a retaining disc 210 surrounding the shaft 186. The stop pins 182 are positioned in the apertures 8 such that, when the stop pins are fully inserted into seat portion 52, the heads 184 of the stop pins 182 are flush with the top surface of the seat portion 52. The seat portion 52 of the support deck 50 may also include an intermediate substrate 208 located on an underside of the seat portion 52. The intermediate substrate 208 engages with the retaining ball 188 when the stop pins 182 are in a raised position, thereby maintaining the stop pins 182 in a raised position with respect to the seat portion 52. The retaining discs 210 prevent the stop pins from being completely withdrawn from the apertures 8.

In the embodiment of the range of motion stop assembly 180 depicted in FIGS. 14A and 14B, the range of motion stop assembly 180 further comprises a stop pin sensor 168 positioned beneath the seat portion 52 of the support deck 50. The stop pin sensor 168 detects when one or more of the stop pins 182 is in a raised position with respect to the support deck 50. The stop pin sensor 168 may comprise a plurality of pressure sensors, a plurality of proximity sensors, a plurality of continuity sensors, or any other sensor suitable for detecting the state (i.e., raised or lowered) of the stop pins with respect to the support deck 50.

Referring to FIGS. 6 and 14A, the lower leg support segment 32 is removably positioned on the leg portion 53 of the support deck 50, as described hereinabove. In order to detect the presence of the lower leg support segment 32 on the leg portion 53, the leg portion 53 may include a cushion sensor 166 positioned on the top surface of the leg portion 53. The cushion sensor 166 may comprise a proximity sensor, a pressure sensor, a light sensor or any other sensor suitable for detecting the presence of the lower leg support segment 32 on the leg portion 53 of the support deck 50.

Figure 18:
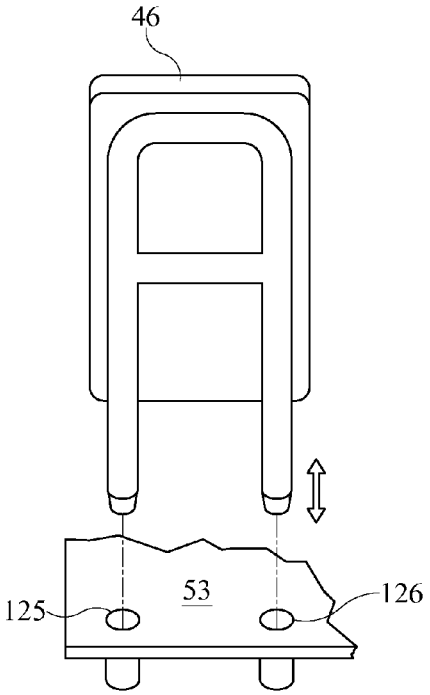
FIG. 18 is a bottom view of a foot plate according to one or more embodiments described herein.
Figure 19:
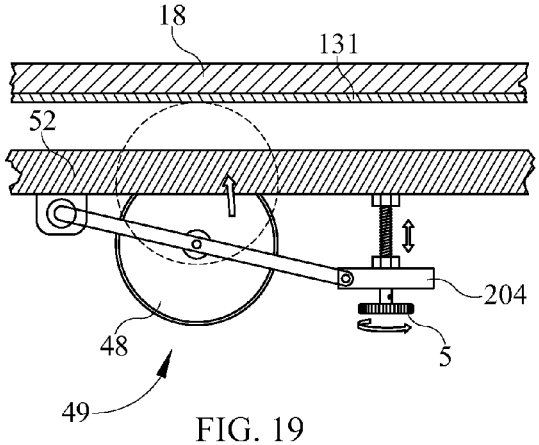
FIG. 19 is a side view of the brake assembly according to one or more embodiments shown and described herein.

Referring now to FIGS. 1, 6 and 18, the patient support apparatus 29 further comprises a stationary exercise support, such as foot plate assembly 41, removably positioned on the support deck 50. In the embodiment of the patient support apparatus 29 shown in FIGS. 1, 6 and 18, the foot plate assembly 41 is positioned proximate a free end of the support deck 50. Specifically, the foot plate assembly 41 is positioned proximate a free end of the leg portion 53 of the support deck 50. The foot plate assembly 41 is positioned to receive the feet of a patient when the patient is positioned on the segmented patient support surface 11 thereby enabling the patient to slide the segmented patient support surface 11 relative to the support deck 50 to perform a closed chain exercise. In the embodiments described herein, the foot plate assembly 41 comprises a right foot plate 46 and a left foot plate 47. As depicted in FIG. 18, the right footplate 46 is removably positioned in the mounting holes 125 and 126 formed in the leg portion 53 of the support deck 50. The left foot plate 47 is attached to the support deck 50 in a similar manner. The left foot plate 47 and the right foot plate 46 may be removed from the support deck 50 and stored in foot plate storage weldments 225, 226 located on the base frame 61 (right foot plate depicted in storage weldments 225, 226 in FIG. 9).

In the embodiments described herein, the foot plate assembly 41 comprises at least one load sensor, such as an LVDT, a piezo-electric pressure transducer or the like, for determining a weight applied to the foot plate assembly 41 by a patient. In the embodiments described herein the left foot plate 47 comprises a left foot load sensor 162 (shown in FIG. 12) and the right foot plate 46 comprises a right foot load sensor 164. As will be described in more detail herein, the left foot and right foot load sensors 164, 162 are communicatively coupled to the control unit 174.

While the stationary exercise support assembly has been described herein as comprising a foot plate assembly, is should be understood that other stationary exercise support assemblies may be used. For example, in one embodiment the stationary exercise support assembly may be a pull-up bar assembly, as described further herein.

Figure 22:
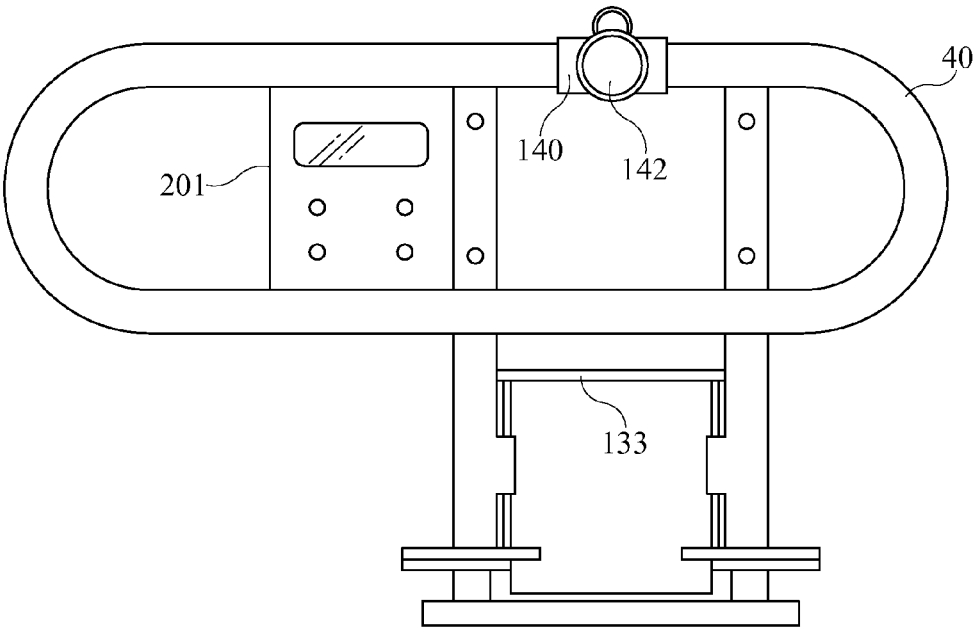
FIG. 22 is a side view of the side rails of the patient support apparatus according to one or more embodiments shown and described herein.
Figure 23:
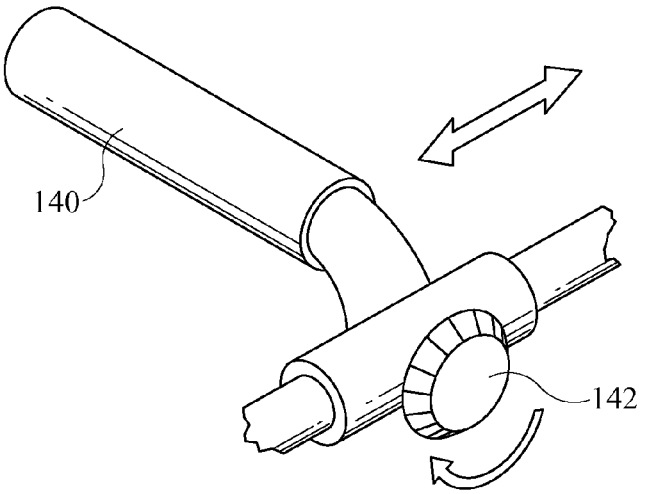
FIG. 23 is a perspective view of the adjustable handles mounted on the side rail according to one or more embodiments shown and described herein.

Referring to FIGS. 1 and 22-23, the patient support apparatus 29 further comprises a pair of side rails 40 positioned on each side of the support deck 50. The side rails 40 are attached to the underside of the support deck 50 and have a raised position relative to the support deck 50, as shown in FIG. 1, and a lowered position relative to the support deck 50. As shown in FIG. 22, side rail 40 further comprises a weight display 201. The weight display 201 is communicatively coupled to the control unit 174 and is operable to display the weight supported by the support deck 50 as registered by the LVDTs located in the load frame 62 and/or the weight applied to the right foot plate 46 and the left foot plate 47 as registered by the right foot plate load sensor and the left foot plate load sensor, respectively.

Side rail 40 can be oriented in the lowered position by pulling the side rail release bar 133 thereby permitting access to the segmented patient support surface 11 by the patient and/or a care giver. The side rails 40 may further comprise one or more exercise handles 140 slidably coupled to the side rails. The exercise handle 140 can be adjusted along the length of the side rail by loosening knob 142 that secures the handle to the rail. When not in use, the exercise handle 140 can be rotated on the side rail to prevent interference with the patient's movement on the segmented patient support surface.

Figure 24:
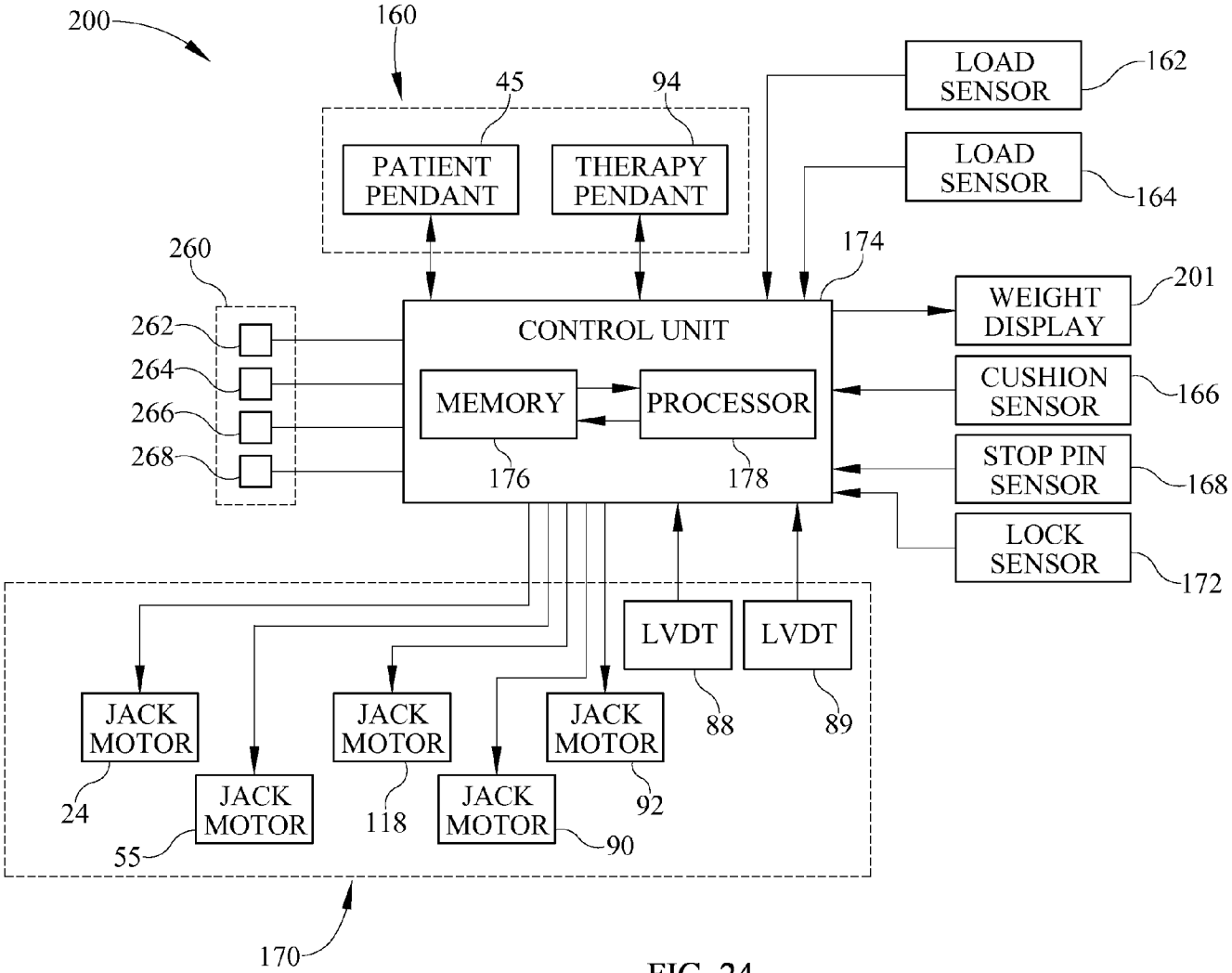
FIG. 24 is a block diagram schematically depicting a control system of the patient support apparatus of FIG. 1, according to one or more embodiments shown and described herein.

Referring now to FIG. 24, the control system 200 for the patient support apparatus is schematically depicted. The control system 200 generally comprises a control unit 174 having a memory 176 for storing computer readable and executable instructions and a processor 178 communicatively coupled to the memory 176. The processor 178 is operable to read the computer readable and executable instructions stored in the memory 176. The control system 200 also comprises a user interface 160 which, in the embodiments described herein, includes a patient control pendant 45 and a therapy control pendant 94 (shown in FIG. 21). The patient control pendant and the therapy control pendant enable a user to control the orientation of various components of the patient support apparatus with various input devices (such as buttons, knobs and the like). The control unit 174 receives signals from the user interface 160 and adjusts the position of the support deck and/or the segmented patient support surface based on the signals received by sending control signals to the jack motors 24, 55, 90, 92, 118 of the lift system 170. Accordingly, it should be understood that the jack motors 24, 55, 90, 92, 118 are communicatively coupled to the control unit 174 and, more specifically, the processor 178 such that the processor 178 can operate the jack motors to achieve the desired patient support apparatus configuration based on user inputs to the control pendants 45, 94.

Figure 21:
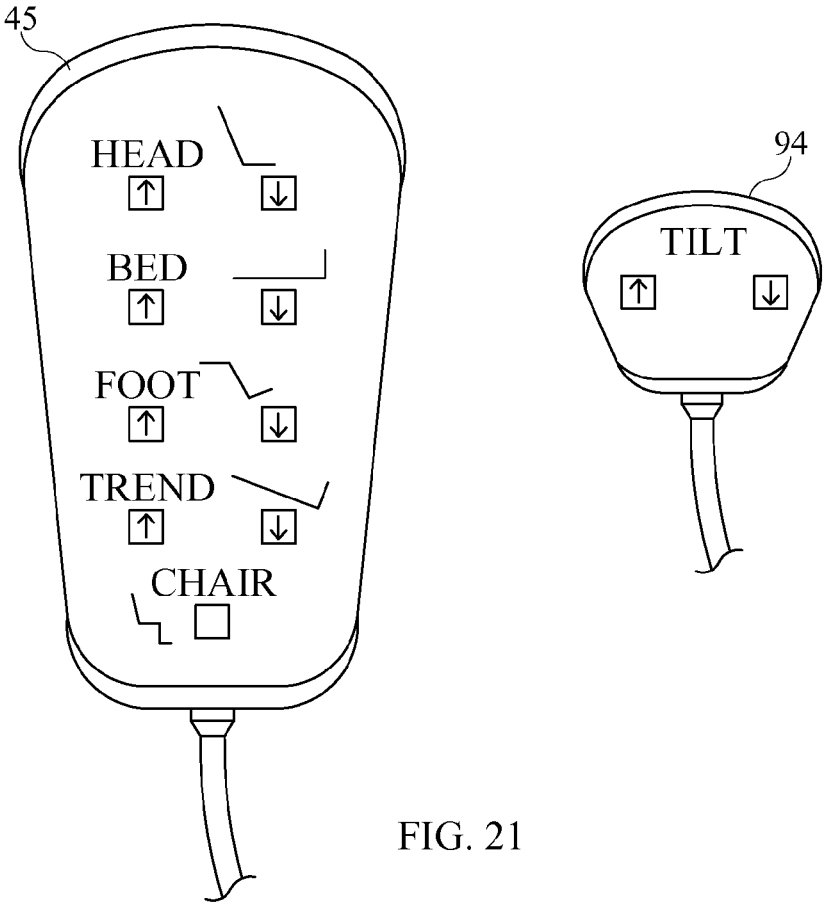
FIG. 21 is a perspective view of the pendants for controlling the patient support apparatus of FIG. 1 according to one or more embodiments shown and described herein.

Referring now to FIGS. 21 and 24, the pendants 45, 94 of the user interface 160 enable a user to control the configuration of the patient support apparatus. In one embodiment, the patient control pendant 45 includes HEAD UP and HEAD DOWN functions which enable a user to adjust the torso support segment with respect to the upper leg support segment to a recumbent position wherein the torso support segment and the upper leg support segment are substantially coplanar or to at least one inclined position wherein the torso support segment is non-coplanar with the upper leg support segment. The patient control pendant 45 also includes BED UP and BED DOWN functions which enable the user to raise and lower the support deck and the segmented patient support surface with respect to the base frame. The patient control pendant 45 may also include FOOT UP and FOOT DOWN functions which enable a user to adjust the leg portion of the support deck to the aligned position wherein the leg portion is substantially coplanar with the seat portion of the support deck or to at least one declined position where in the leg portion is non-coplanar with the seat portion of the support deck. The patient control pendant 45 may also include TREND UP and TREND DOWN functions which enable the user to orient the support deck and segmented patient support surface to the TRENDELENBURG orientation or REVERSE TRENDELENBURG orientation, as described herein. In the embodiment shown in FIG. 21, the patient control pendant 45 also includes a CHAIR function which positions the upper torso support segment to a fully inclined position with respect to the support deck and upper leg support segment and positions the leg portion of the support deck to a fully declined position with respect to the seat portion of the support deck.

Still referring to FIG. 21, the therapy support pendant 94 includes TILT UP and TILT DOWN functions which allow a user, specifically a care giver, to increase or decrease the tilt the support deck relative to the base frame.

Referring again to FIG. 24, the left and right foot plate load sensors 162, 164 are communicatively coupled to the control unit 174 and operable to send signals to the control unit indicative of the weight applied to each foot plate. In addition, the LVDTs 88, 89 of the load frame are communicatively coupled to the control unit 174 and operable to send signals to the control unit 174 indicative of the weight applied to the load frame. The weight display 201 is communicatively coupled to the control unit 174. The processor 178 receives the signals from the left and right foot plate load sensors 162, 164 and the LVDTs 88, 89 and displays the weight registered by these sensors on the weight display 201.

In addition, the cushion sensor 166 positioned on the leg portion of the support deck and the stop pin sensor 168 of the range of motion stop assembly are also communicatively coupled to the control unit 174. In embodiments where the patient support apparatus further comprises a lock sensor 172, the lock sensor 172 is also communicatively coupled to the control unit 174. Further, the control system 200 may also comprise an exercise mode indicator 260 which includes a cushion indicator 262, a stop pin indicator 264, a tilt OK indicator 266 and, in some embodiments, a carriage lock indicator 268, each of which are communicatively coupled to the control unit 174. The exercise mode indicator 260 may be positioned on a side rail of the patient support apparatus or, alternatively, on the therapy control pendant 94 or the patient control pendant 45 of the user interface. Indicators 262, 264, 266, 268 may be visual indicators, such as LEDs or the like, and/or audible indicators, such as a buzzer or an electronic chime.

The control unit 174 is operable to receive signals from the cushion sensor 166, the stop pin sensor 168 and the lock sensor 172 and illuminate the corresponding indicator upon the occurrence of a specified condition. For example, in one embodiment, the cushion indicator 262 is activated by the control unit 174 when the signal received from the cushion sensor 166 indicates that the lower leg support segment is not positioned on the leg portion of the support deck. Similarly, the stop pin indicator 264 is activated by the control unit 174 when the signal received from the stop pin sensor 168 indicates that one or more of the stop pins is in a raised position in the path of travel of the carriage. In embodiments where the patient support apparatus includes a lock sensor 172, the carriage lock indicator 268 is activated by the control unit 174 when the lock sensor 172 indicates that the carriage lock pin is inserted in the support deck.

In one embodiment, the control unit 174 is programmed to prevent the support deck from being tilted into an exercise orientation until the cushion sensor 166, the stop pin sensor 168, and the lock sensor 172 respectively indicate that the lower leg support segment has been removed from the leg portion of the support deck, at least one stop pin is raised from the support deck and positioned in the path of travel of the carriage, and the carriage lock is not inserted in the support deck. When these conditions are met, the control unit 174 activates the tilt OK indicator 266 and permits the support deck to be tilted by a user through the user interface 160.

In another embodiment, when the patient support apparatus additionally comprises a lock sensor 172, the control unit 174 is programmed to prevent the support deck from being tilted into an exercise orientation until the cushion sensor 166 and the stop pin sensor 168 indicate that the lower leg support segment has been removed from the leg portion of the support deck and at least one stop pin is raised from the support deck and positioned in the path of travel of the carriage. When both of these conditions are met, the control unit 174 activates the tilt OK indicator 266 and permits the support deck to be tilted by a user through the user interface 160.

Various orientations of the patient support apparatus will now be described in more detail with specific reference to the figures.

Referring now to FIG. 6, the patient support apparatus is depicted in a bed orientation. Specifically, FIG. 6 depicts the patient support apparatus 29 in the conventional bed orientation with the support deck 50 in a neutral orientation (i.e. a substantially horizontal orientation) and the side rail 40 in the raised position. The torso support segment 30 of the segmented patient support surface is elevated by the incline jack motor 55 and incline jack sleeve 56 such that the torso of the patient is slightly inclined with respect to the patient's legs. This orientation may be achieved by actuating the incline jack motor 55 with the HEAD UP function of the patient control pendant. However, it should be understood that the torso support segment 30 may also be lowered to a horizontal position utilizing the HEAD DOWN function of the patient control pendant to actuate the incline jack motor 55.

Referring to FIG. 8, the patient support apparatus is depicted in a reclining chair orientation. In this orientation the leg portion 53 of the support deck 50 is in a decline position which is achieved by actuating the decline jack motor 24 with the LEGS DOWN function of the patient control pendant. In the reclining chair orientation, the torso support segment 30 is in an inclined position such that the torso support segment 30 is non-coplanar with the upper leg support segment 31 which may be achieved by actuating the incline jack motor 55 with the HEAD UP function of the patient control pendant. In some embodiments, the support deck 50, and more specifically, the seat portion 52 of the support deck 50 may be tilted with respect to the base frame such that the head end of the seat portion is declined. As shown in FIG. 8, the lower leg support segment is not positioned on the leg portion 53 of the support deck 50. In an alternative embodiment, the reclining chair orientation of the patient support apparatus may be achieved with the CHAIR function of the patient control pendant 45.

Figure 9:
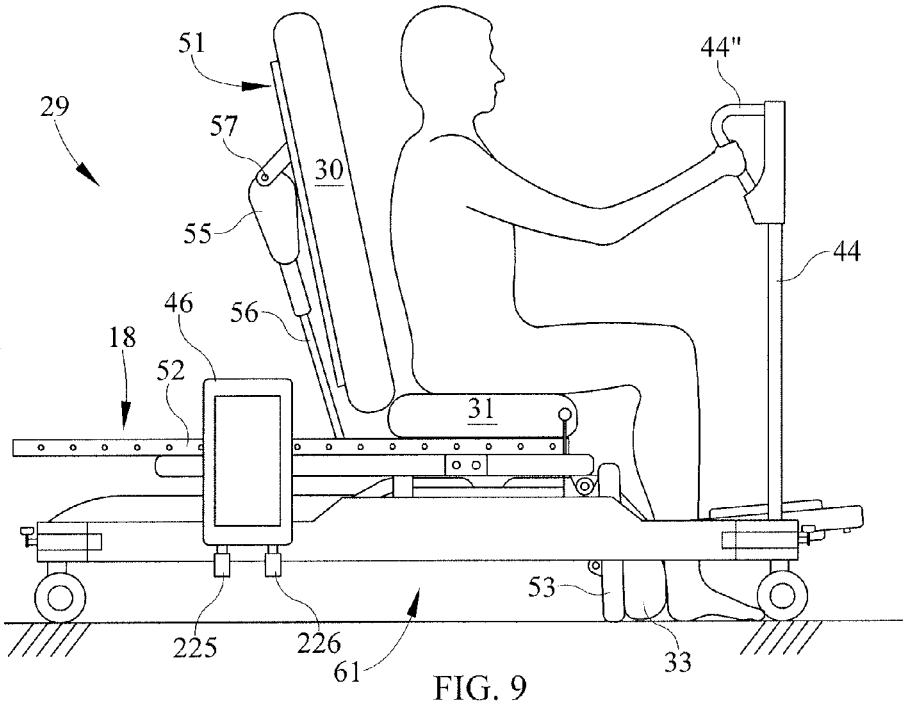
FIG. 9 is a side view of the patient support apparatus of FIG. 1 in the egress orientation according to one or more embodiments shown and described herein.

Referring to FIG. 9, the patient support apparatus is positioned in the egress orientation. As with the chair orientation discussed above, the egress orientation is achieved by actuating the decline jack motor 24 with the LEGS DOWN function of the patient control pendant to bring leg portion 53 of the support deck 50 to a maximum decline position while the torso support segment 30 is pivoted to an inclined position such that the torso support segment 30 is non-coplanar with the upper leg support segment 31 by actuating the incline jack motor 55 with the HEAD UP function of the patient control pendant. However, in the egress orientation, the left and right foot plates are removed from the leg portion 53 of the support deck and stowed in the foot plate storage weldments 225, 226. The right foot plate 46 is depicted stowed in the foot plate storage weldments 225, 226 in FIG. 9. Removal of the foot plates allows the feet of the patient to contact the ground and thereby transition to standing. To facilitate the egress orientation the seat portion 52 of the support deck is lowered to its lowest position relative to the base frame 61 by using the patient pendant control to actuation of the jack motors. In the embodiment shown in FIG. 9 a stanchion 44 with handle 44" is positioned at the end of the base frame 61 to assist the patient in transitioning to a standing position.

Figure 10:
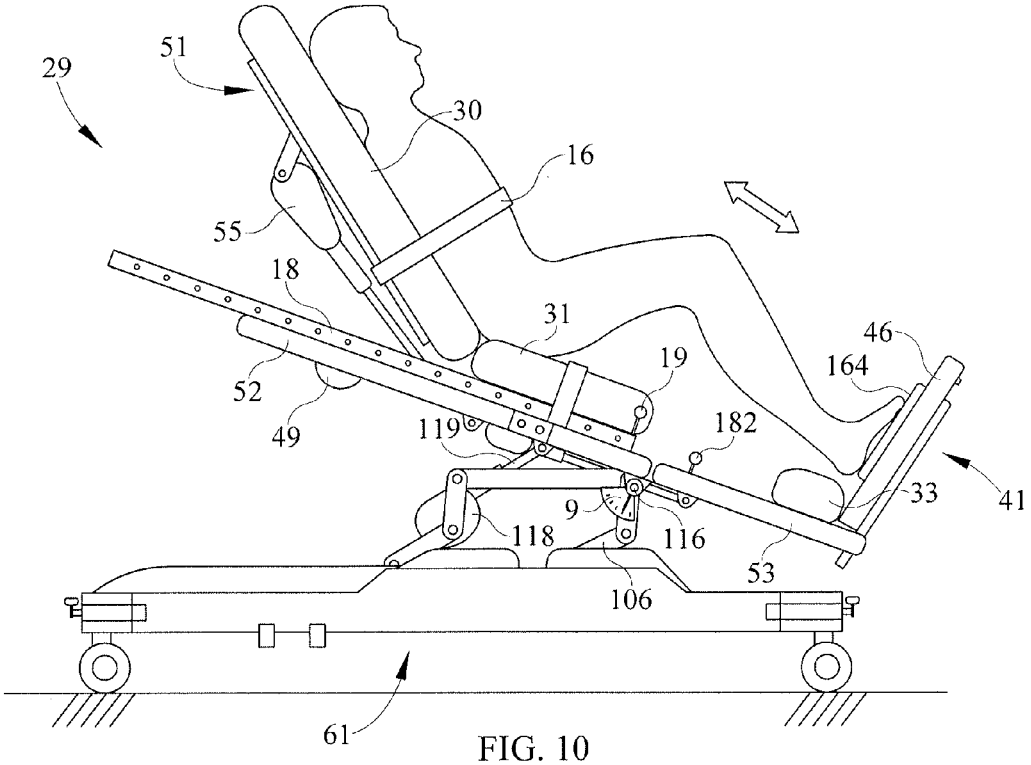
FIG. 10 is a side view of the patient support apparatus of FIG. 1 in the exercise orientation according to one or more embodiments shown and described herein.

Referring now to FIG. 10, the patient support apparatus 29 is shown in an exercise orientation. In this orientation, the foot plate assembly 41 is positioned on the leg portion 53 of the support deck 50 and the leg portion 53 is in the aligned position with respect to the seat portion 52 of the support deck 50. The support deck 50 is raised relative to the base frame 61 which may be accomplished by using the BED UP function of the patient control pendant to actuate the jack motors in the load frame. The torso support segment 30 is in an inclined position such that the torso support segment 30 is non-coplanar with the upper leg support segment 31 which may be achieved by actuating the incline jack motor 55 with the HEAD UP function of the patient control pendant. The support deck is tilted with respect to the base frame such that the seat portion of the support deck is higher than the leg portion of the support deck. This positioning may be accomplished by actuating the tilt jack motor 118 with the TILT UP function of the therapy control pendant. As described hereinabove with respect to the control system depicted in FIG. 24, the TILT UP function of the therapy control unit may be locked out and tilting of the support deck may be prevented by the control until at least the lower leg support segment is removed from the leg portion 53 of the support deck 50 and at least one stop pin 182 is positioned in the path of travel of the carriage 18 on the support deck 50, as is depicted in FIG. 10. Once the carriage lock mechanism 19 has been disengaged, the carriage 18 and the upper leg support segment 31 and torso support segment 30 are freely slidable on the patient support deck 50.

Referring to FIGS. 10 and 16, a patient is depicted seated in the patient support apparatus 29 with the patient support apparatus in the exercise orientation. Specifically, the patient is seated on the upper leg support segment 31 such that the patients feet are engaged with the foot plate assembly 41 and the patient is reclined against the torso support segment 30. The patient is secured to the torso support segment 30 with support strap 16 which is secured to strap weldments 12, 13 located at either side of the underside of the torso support segment 30. The patient is depicted performing a closed chain exercise which, in the embodiment shown in FIG. 10, is a leg press exercise. The leg press exercise is accomplished by the patient pressing against the foot plate assembly 41 as the patient straightens his or her legs which, in turn, slides the carriage 18 upwards on the support deck 50 and away from the foot plate assembly 41. The patient then bends his or her knees to slide the carriage 18 back towards the foot plate assembly 41 in a controlled manner. The brake assembly (not shown) described hereinabove, prevents the rapid acceleration of the carriage 18 with respect to the support deck 50. In addition, the stop pins 182 limit the range of motion of the carriage 18 in the direction towards the foot plate assembly 41. Resistance during the leg press exercise is a fraction of the patient's body weight and is dependent on the tilt angle of the support deck 50 with respect to the base frame 61. For example, a tilt angle of 20-degrees is approximately 45% body weight and a tilt angle of 35-degrees is approximately 75% body weight. By adjusting the angle of the patient support apparatus with the tilt jack motor 118, the patient can perform a leg press exercise with a tolerable amount of resistance to enhance leg strength in preparation for standing. In the embodiment of the patient support apparatus 29 shown in FIG. 10, an angle indicator 9 is located at the bearing pivot 116 and provides a visual indication of the tilt angle of the support deck 50 with respect to the base frame 61. Therapy control pendant 94 may be used to control the tilt jack motor 118 with the TILT UP or TILT DOWN functions, as described above.

Figure 11A:
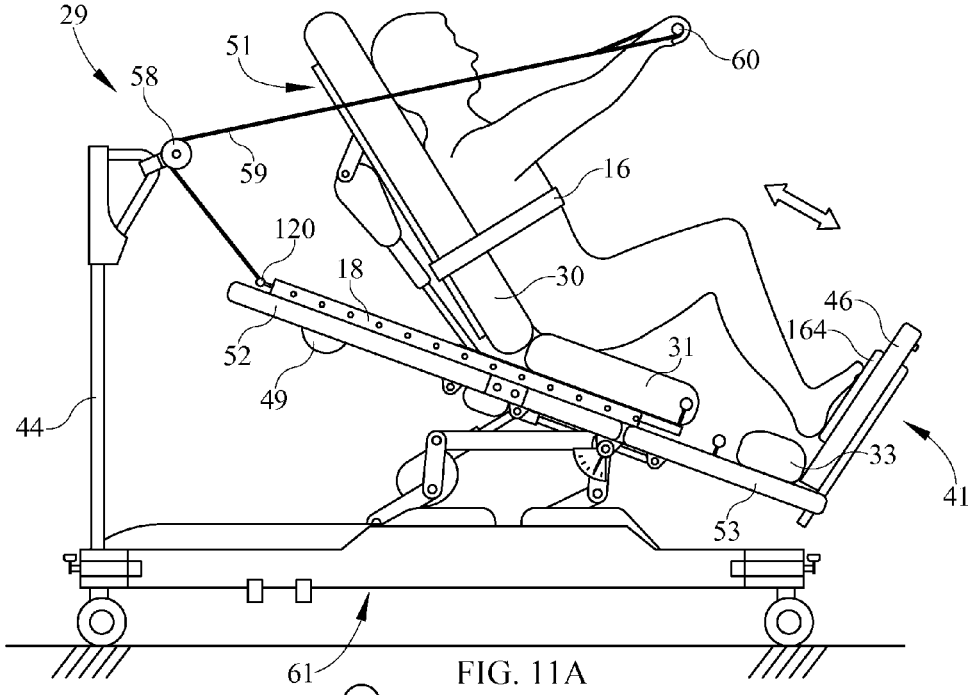
FIG. 11A is a side view of the patient support apparatus of FIG. 1 in the upper extremity exercise orientation according to one or more embodiments shown and described herein.

Referring now to FIG. 11A, the patient support apparatus 29 is depicted being used to perform a closed chain exercise which, in this embodiment, is an upper extremity exercise performed with a second type of stationary exercise support, specifically an upper extremity exercise assembly. In this example, at least one stanchion 44 is attached to the base frame 61 and an upper extremity exercise assembly is attached to the stanchion. In this embodiment, the upper extremity exercise assembly includes at least one cable 59 connected to the carriage 18 at eye bolt 120. The cable 59 is routed through at least one pulley 58 which is connected to the stanchion 44. A free end of the cable 59 may include a handle 60 which a patient may grasp. When the patient tensions a free end of the cable 59, the carriage 18 slides with respect to the support deck and away from the foot plate assembly 41 thereby sliding the segmented patient support surface with respect to the support deck. The resistance experienced by the patient during this exercise is dependent on the angle of inclination of the support deck, as described above. Closed chain exercises performed with such an apparatus may be used to assist the patient in performing a leg press exercise, as described above, or may be utilized as a stand alone exercise to solely strengthen the upper extremities of the patient, such as when the patient does not engage his or her feet with the foot plate assembly 41.

Figure 11B:
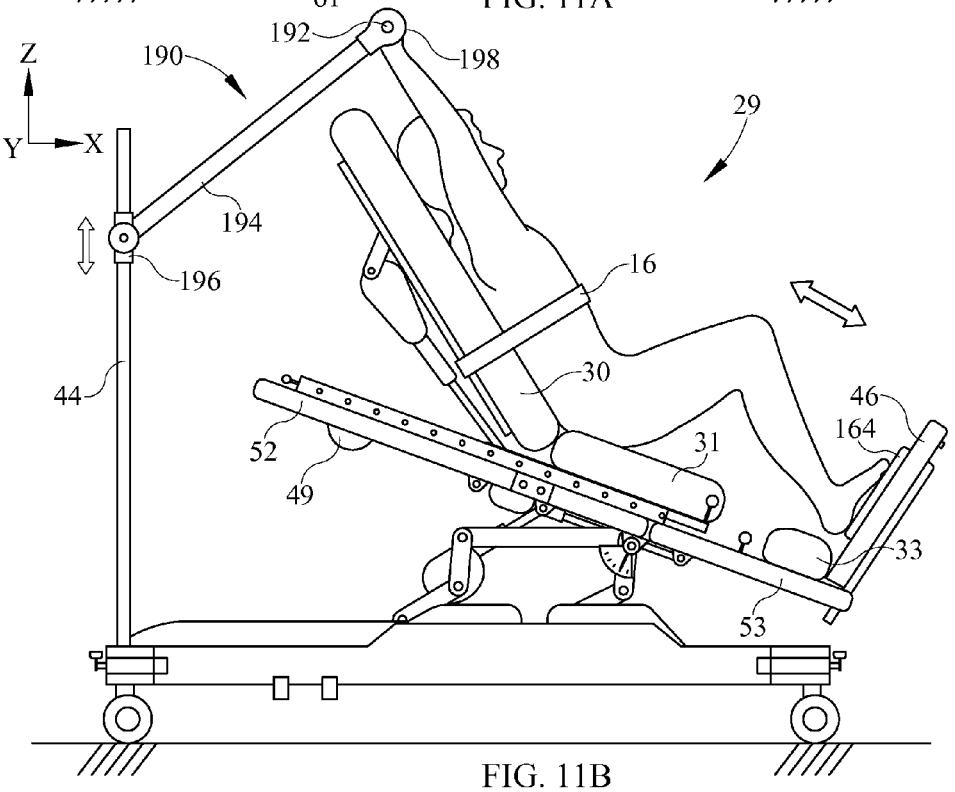
FIG. 11B is a side view of the patient support apparatus of FIG. 1 in the upper extremity exercise orientation according to one or more embodiments shown and described herein.

Referring now to FIG. 11B, the patient support apparatus 29 is depicted being used to perform a closed chain exercise with yet another type of stationary exercise support which, in this embodiment, is an upper extremity exercise, specifically a pull-up bar assembly. In this example, at least one stanchion 44 is attached to the base frame 61 and an upper extremity exercise assembly is attached to the stanchion. In this embodiment, the upper extremity exercise assembly includes a pull-up bar assembly 190 attached to the stanchion 44. The pull-up bar assembly includes a support strut 194 which is coupled to the stanchion 44 with an adjustable fitting 196 such that the pull-up bar is vertically adjustable (i.e., in the + or −Z direction of the coordinate axes shown in FIG. 11B). A pull-up bar 192 is attached at the opposite end of the support strut 194 with pull-up bar mount 198 such that the pull-up bar is positioned over the patient. The patient may grasp and pull against the pull-up bar assembly thereby sliding the segmented patient support surface with respect to the support deck. The resistance experienced by the patient during this exercise is dependent on the angle of inclination of the support deck, as described above. Closed chain exercises performed with such an apparatus may be used to assist the patient in performing a leg press exercise, as described above, or may be utilized as a stand alone exercise to solely strengthen the upper extremities of the patient, such as when the patient does not engage his or her feet with the foot plate assembly 41.

Figure 12:
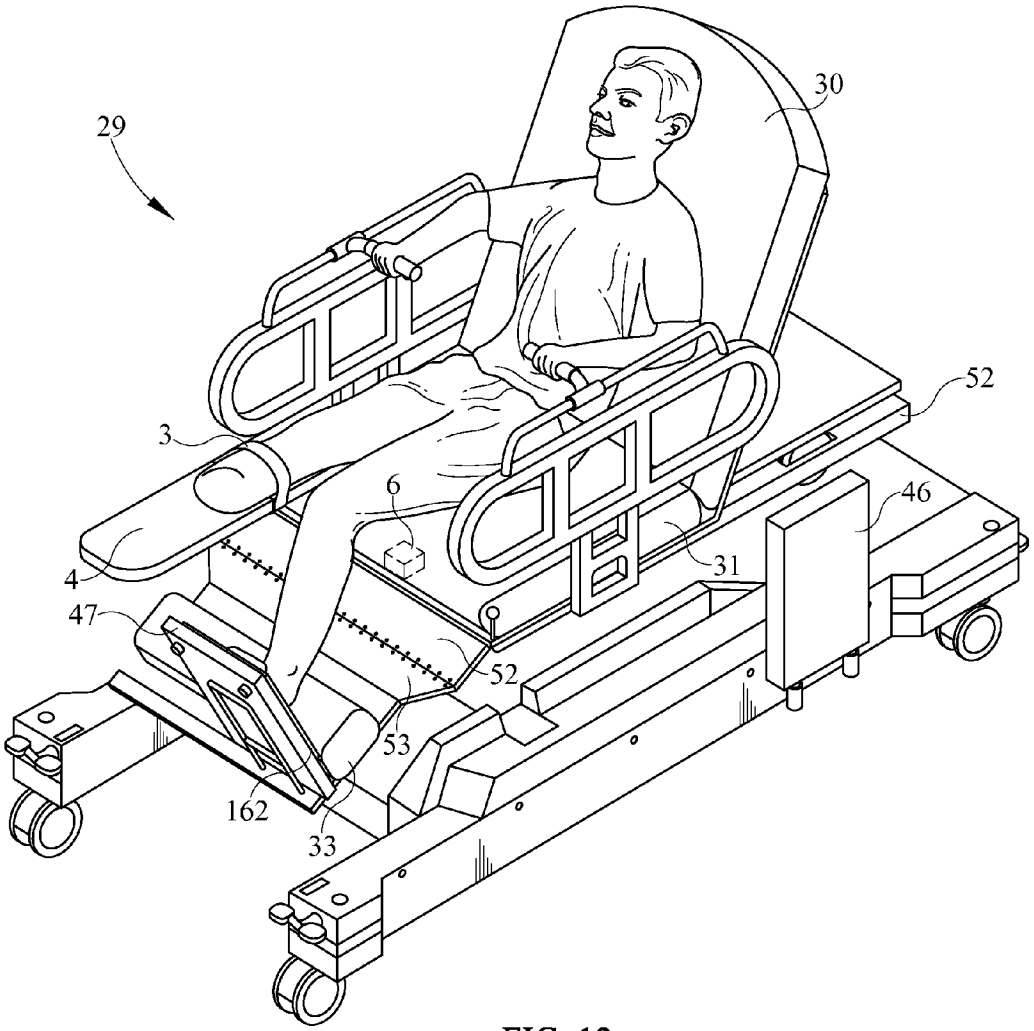
FIG. 12 is a perspective view of the patient support apparatus of FIG. 1 showing use of the bed in the unilateral lower extremity exercise orientation by an amputee patient according to one or more embodiments shown and described herein.
Figure 17:
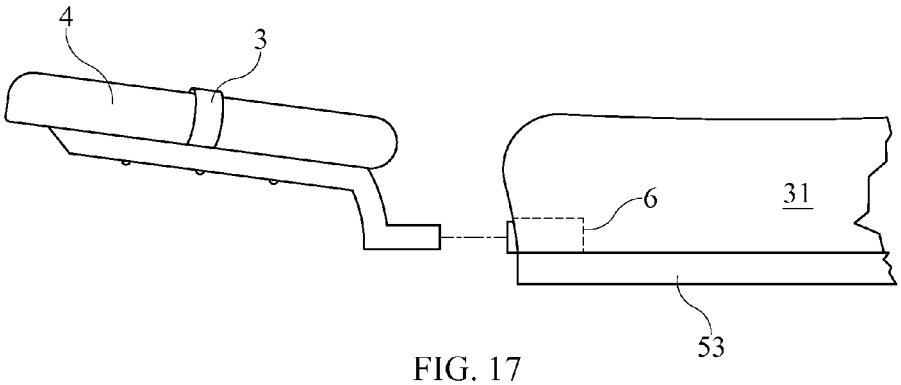
FIG. 17 is a side view of the amputee support pad attachment to the carriage according to one or more embodiments shown and described herein.

Referring now to FIGS. 12 and 17, the patient support apparatus is depicted in use by an amputee patient to perform a unilateral leg strengthening exercise. In this example, the patient support apparatus is oriented in the exercise orientation as described hereinabove with respect to FIG. 10. However, in this example, an amputee support pad 4 is attached to the carriage 18. Specifically, the amputee support pad 4 is secured into a support pad receptacle 6 located on the free end of the carriage 18 (see FIG. 17). The amputee support pad has a restraining strap 3 which secures the injured limb and elevates the limb to allow one leg squat exercise to be performed on the patient support apparatus. To perform this function, the footplate on the side of the amputee support pad 4 is removed to allow the patient to exercise without the injured limb contacting the footplate. This function can be used for patients with either an amputation or a non-weight-bearing limb, such as a fractured leg or hip, to allow strengthening of the unaffected leg.

Referring now to FIG. 13, the patient support apparatus 29 is depicted in a tilt orientation wherein the support deck is tilted up to angle of less than 90 degrees with respect to the base frame 61. In some embodiments, the tilt angle of the support deck 50 is 85 degrees or less. In the tilt orientation the carriage is locked to the support deck 50 with the carriage lock mechanism 19 thereby preventing movement of the carriage with respect to the support deck 50. The leg portion 53 of the support deck 50 is in the aligned position with respect to the seat portion 52 of the support deck 50 which is achieved with the LEGS UP function of the patient control pendant. The torso support segment 30 is in the recumbent position with respect to the upper leg support segment 31 which is achieved with the HEAD DOWN function of the patient control pendant. The support deck 50 is tilted with respect to the base frame 61 by actuating the tilt jack motor 118 with the TILT UP function of the therapy control pendant. As shown in FIG. 13, the patient is secured to patient support apparatus at the chest, waist and knees with support straps 15, 16 and 17. The straps are secured to strap weldments 12, 121, 122 located on the underside of the patient support surface.

The patient support apparatus has been described herein as comprising a support deck to which the torso support segment and the upper leg support segment of a segmented patient surface are slidably coupled. Moreover, the patient support deck has been described as comprising a seat portion and a leg portion which facilitates positioning the patient support apparatus in a chair orientation. However, it should be understood that embodiments of the patient support apparatus which facilitate a leg elevation orientation are also contemplated.

Figure 25:
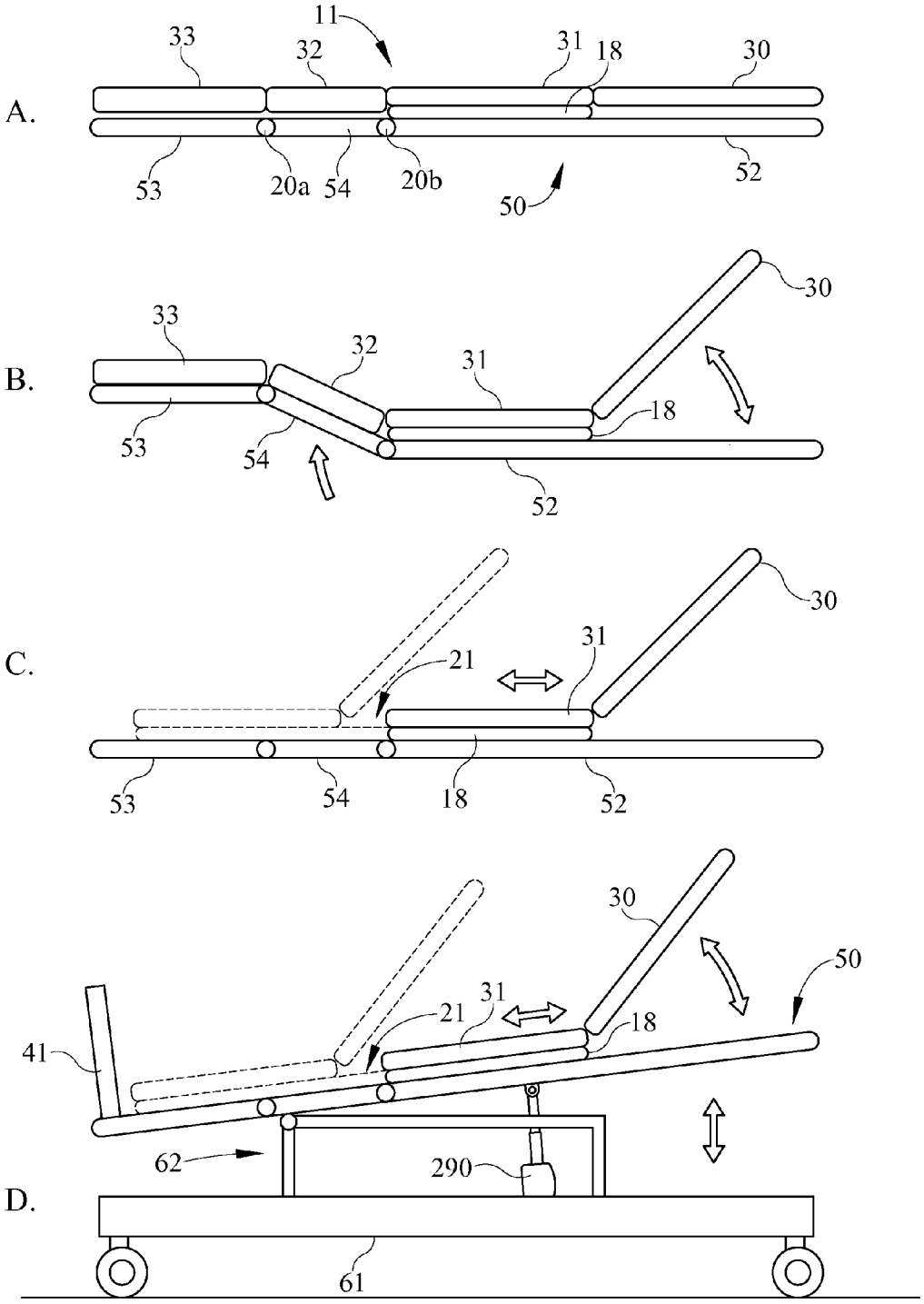
FIGS. 25A-25D are partial side views of one embodiment of a patient support apparatus according to one or more embodiments shown and described herein.

Referring to FIGS. 25A-25D by way of example, an embodiment of a support deck 50 is depicted which enables a leg elevation function. In this embodiment, the support deck 50 includes a seat portion 52, an intermediate portion 54 pivotally coupled to an end of the seat portion 52 with hinge 20*b*, and a leg portion 53 pivotally coupled to an end of the intermediate portion 54 with hinge 20*a*. A conventional lift system (not shown) may be coupled to the support deck 50 to enable pivoting the intermediate portion 54 with respect to the seat portion 52 and the leg portion 53 with respect to the intermediate portion 54 such that the leg portion 53 is elevated relative to the seat portion 52 to achieve a leg elevation orientation, as depicted in FIG. 25B. Specifically, the intermediate portion 54 of the support deck 50 is positionable in an aligned position wherein the intermediate portion 54, the leg portion 53 and the seat portion 52 are substantially coplanar with one another, as depicted in FIG. 25A. The intermediate portion 54 is also positionable in at least one intermediate position wherein the intermediate portion 54 is inclined with respect to the seat portion 52 and declined with respect to the leg portion 53, as shown in FIG. 25B.

In this embodiment, a segmented patient support surface 11 is positioned on the support deck 50 and comprises a torso support segment 30, an upper leg support segment 31, and a lower leg support segment 32, and an ankle support segment 33 as described hereinabove. However, in this embodiment, both the lower leg support segment 32 and the ankle support segment 33 are removably attached to respective portions of the support deck 50 so as to enable an exercise orientation of the support deck 50 and upper leg support segment 31. A foot plate assembly 41 may be removably attached to the leg portion 53 of the support deck 50 as described hereinabove.

In this embodiment, at least the torso support segment 30 and the upper leg support segment 31 are slidably coupled to the support deck 50 such that the torso support segment 30 and the upper leg support segment 31 are freely slidable with respect to the support deck 50, as described hereinabove and shown in FIGS. 25C and 25D. In one embodiment, the torso support segment 30 and the upper leg support segment 31 are slidably attached to the seat portion 52 with carriage 18. The carriage 18 is coupled to the seat portion 52 with sliding rails 21, such as telescopically sliding rails, which enable the carriage to slide relative to the support deck 50, as described hereinabove. Further, the lift system (not shown) may also be coupled to the torso support segment 30 such that the torso support segment is pivotable with respect to the upper leg support segment from a reclined position wherein the torso support segment and the upper leg support segment are substantially coplanar, as shown in FIG. 25A, and at least one inclined position wherein the torso support segment is non-coplanar with the upper leg support segment as shown in FIG. 25B.

Patient support apparatuses with support decks of this configuration may have an exercise orientation as depicted in FIG. 25D. Specifically, in the exercise orientation, the lower leg support segment 32 and the ankle support segment 33 are removed from the support deck 50 and the torso support segment 30 is in the inclined position with respect to the upper leg support segment 31 and the intermediate portion 54 of the support deck 50 is positioned in an aligned position such that the intermediate portion 54 is substantially coplanar with the seat portion 52 and the leg portion 53. The support deck 50 is tilted with respect to the base frame 61 such that the seat portion 52 of the support deck 50 is higher that the leg portion 53 of the support deck 50 relative to the base frame 61. Tilting the support deck in this manner may be accomplished with jack motor 290 positioned in load frame 62, to which the support deck 50 is pivotally attached. When the patient support apparatus is positioned in the exercise configuration, as depicted in FIG. 25D, the carriage, torso support segment 30, and upper leg support segment 31 are freely slidable on the support deck 50 towards and away from foot plate assembly 41. The patient support apparatus may then be used to perform closed chain exercises, as described hereinabove.

It should now be understood that the patient support apparatuses described herein can be configured in a bed orientation, a chair orientation, an egress orientation, an exercise orientation, or a tilt orientation. When in the tilt orientation, the patient support apparatus may also be utilized as a tilt table to assist with raising a patient to a standing position. When in the exercise orientation, having the torso support segment and the upper leg support segment slidably coupled to the support deck facilitates use of the patient support apparatus to perform closed chain exercises which utilize a patient's own body weight to increase the strength and range of motion of both upper and lower extremities, and to improve the conditioning of a patient. Further, it should also be understood that the braking assembly incorporated in the patient support apparatus may be used to mitigate rapid acceleration of the torso support segment and the upper leg support segment relative to the support deck thereby providing more uniform resistance throughout the complete range of motion of the exercise.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A patient support apparatus comprising:

a base frame;

a support deck supported on the base frame such that the support deck is pivotable with respect to the base frame, the support deck comprising a seat portion, an intermediate portion pivotally coupled to an end of the seat portion, and a leg portion pivotally coupled to an end of the intermediate portion;

a carriage slidably coupled to the seat portion of the support deck such that the carriage is freely slidable at least between a head of the support deck and a foot of the support deck; and a foot plate assembly removably positioned proximate a free end of the support deck.

2. The patient support apparatus of claim 1, wherein:

the support deck comprises a pair of spaced longitudinal beams; and the carriage is slidably coupled to the pair of spaced longitudinal beams.

3. The patient support apparatus of claim 2, wherein the carriage is slidably coupled to the spaced longitudinal beams with sliding rails.

4. The patient support apparatus of claim 3, wherein the sliding rails are telescoping sliding rails having an extended position wherein the sliding rails are positioned over at least a portion of the leg portion of the support deck and a retracted position wherein the sliding rails are not positioned over the leg portion of the support deck.

5. The patient support apparatus of claim 1, further comprising a lift system pivoting the leg portion of the support deck with respect to the seat portion of the support deck.

6. The patient support apparatus of claim 1, wherein the foot plate assembly is removably positioned on the leg portion of the support deck.

7. The patient support apparatus of claim 1, wherein the leg portion of the support deck is positionable between an aligned position wherein the leg portion is substantially coplanar with the seat portion and at least one declined position wherein the leg portion is non-coplanar with the seat portion.

8. The patient support apparatus of claim 7, wherein the patient support apparatus has an exercise orientation wherein:

the leg portion of the support deck is in the aligned position with respect to the seat portion of the support deck; and the support deck is tilted with respect to the base frame such that the seat portion of the support deck is higher than the leg portion of the support deck.

9. The patient support apparatus of claim 7, wherein the patient support apparatus has a tilt orientation wherein:

the leg portion of the support deck is in the aligned position with respect to the seat portion of the support deck; and the support deck is tilted with respect to the base frame, wherein a tilt angle between the support deck and the base frame is greater than zero and less than or equal to about 90 degrees.

10. The patient support apparatus of claim 1, further comprising a head frame coupled to the carriage with an actuator, the head frame having an inclined position with respect to the support deck.

11. The patient support apparatus of claim 1, wherein the intermediate portion of the support deck is positionable between an aligned position wherein the intermediate portion, the leg portion and the seat portion are substantially coplanar with one another and at least one intermediate position wherein the intermediate portion is inclined with respect to the seat portion and declined with respect to the leg portion.

12. The patient support apparatus of claim 11 wherein the patient support apparatus has an exercise configuration wherein:

the intermediate portion of the support deck is positioned in the aligned position; and the support deck is tilted with respect to the base frame such that the seat portion of the support deck is higher than the leg portion of the support deck.

13. The patient support apparatus of claim 1, wherein the support deck is pivotable with respect to the base frame such that the support deck is positionable in at least a neutral orientation wherein the support deck is substantially horizontal, a Trendelenburg orientation wherein a head of the support deck is lower than a foot of the support deck, and a reverse Trendelenburg orientation wherein the foot of the support deck is lower than the head of the support deck.

14. The patient support apparatus of claim 1, further comprising a carriage lock mechanism releasably securing the carriage to the support deck such that the carriage does not slide with respect to the support deck.

15. The patient support apparatus of claim 1, further comprising a range of motion stop assembly positioned in a path of travel of the carriage.

16. The patient support apparatus of claim 15, wherein the range of motion stop assembly comprises a plurality of stop pins positioned in apertures formed in the support deck.

17. The patient support apparatus of claim 16, wherein the range of motion stop assembly further comprises a stop pin sensor detecting a raised or lowered state of at least one of the plurality of stop pins.

18. The patient support apparatus of claim 1, further comprising a brake assembly regulating a rate of travel of the carriage relative to the support deck.

19. The patient support apparatus of claim 1, further comprising a lift system coupled to the base frame and the support deck.

20. A patient support apparatus comprising:

a base frame;

a support deck supported on the base frame such that the support deck is pivotable with respect to the base frame, the support deck comprising a seat portion, an intermediate portion pivotally coupled to an end of the seat portion, and a leg portion pivotally coupled to an end of the intermediate portion;

a carriage slidably coupled to the support deck such that the carriage is freely slidable at least between a head of the support deck and a foot of the support deck; and a stationary exercise support removably positioned on the patient support apparatus.

21. The patient support apparatus of claim 20, wherein the stationary exercise support is a foot plate assembly positioned proximate a free end of the leg portion of the support deck, the foot plate assembly comprising at least one load sensor, the at least one load sensor determining a weight applied to the foot plate assembly.

22. The patient support apparatus of claim 21, wherein the foot plate assembly comprises a left foot plate and a right foot plate, the left foot plate comprising a left foot load sensor and the right foot plate comprising a right foot load sensor.

23. The patient support apparatus of claim 20, wherein the stationary exercise support is an upper extremity exercise assembly attached to at least one stanchion attached to the base frame.

24. The patient support apparatus of claim 23, wherein the upper extremity exercise assembly comprises:

at least one pulley supported on the at least one stanchion; and at least one cable coupled to the carriage and routed through the at least one pulley, wherein tensioning a free end of the at least one cable slides the carriage with respect to the support deck.

25. The patient support apparatus of claim 23, wherein the upper extremity exercise assembly comprises a pull-up bar assembly attached to the at least one stanchion, wherein a position of the pull-up bar assembly on the at least one stanchion is vertically adjustable on the at least one stanchion.

26. The patient support apparatus of claim 20, further comprising a lift system coupled to the base frame and the support deck.

27. The patient support apparatus of claim 20, wherein the intermediate portion of the support deck is positionable between an aligned position wherein the intermediate portion, the leg portion and the seat portion are substantially coplanar with one another and at least one intermediate position wherein the intermediate portion is inclined with respect to the seat portion and declined with respect to the leg portion.

28. A patient support apparatus comprising:

a base frame;

a support deck supported on the base frame such that the support deck is pivotable with respect to the base frame, the support deck comprising a seat portion, an intermediate portion pivotally coupled to an end of the seat portion, and a leg portion pivotally coupled to an end of the intermediate portion;

a carriage slidably coupled to the seat portion of the support deck such that the carriage is freely slidable at least between a head of the support deck and a foot of the support deck;

a head frame coupled to the carriage, the head frame having at least one inclined position with respect to the support deck; and a stationary exercise support removably positioned on the patient support apparatus.

29. The patient support apparatus of claim 28, wherein the stationary exercise support is a foot plate assembly positioned proximate a free end of the leg portion of the support deck.

30. The patient support apparatus of claim 28, wherein the stationary exercise support is an upper extremity exercise assembly attached to at least one stanchion attached to the base frame.

31. The patient support apparatus of claim 28, wherein the leg portion of the support deck is positionable between an aligned position wherein the leg portion is substantially coplanar with the seat portion and at least one declined position wherein the leg portion is non-coplanar with the seat portion.

32. The patient support apparatus of claim 31, wherein the patient support apparatus has an exercise orientation wherein:

the head frame is in the at least one inclined position with respect to the support deck;

the leg portion of the support deck is in the aligned position with respect to the seat portion of the support deck; and the support deck is tilted with respect to the base frame such that the seat portion of the support deck is higher than the leg portion of the support deck.

33. The patient support apparatus of claim 31, wherein the head frame further comprises a recumbent position with respect to the support deck and the patient support apparatus has a tilt orientation wherein:

the head frame is in the recumbent position with respect to the support deck;

the leg portion of the support deck is in the aligned position with respect to the seat portion of the support deck; and the support deck is tilted with respect to the base frame, wherein a tilt angle between the support deck and the base frame is greater than zero and less than or equal to about 90 degrees.

34. The patient support apparatus of claim 31, wherein the patient support apparatus has an egress orientation wherein:

the head frame is in the at least one inclined position with respect to the support deck; and the leg portion of the support deck is in the at least one declined position with respect to the seat portion of the support deck.

35. The patient support apparatus of claim 28, wherein the support deck is pivotable with respect to the base frame such that the support deck is positionable in at least a neutral orientation wherein the support deck is substantially horizontal, a Trendelenburg orientation wherein a head of the support deck is lower than a foot of the support deck, and a reverse Trendelenburg orientation wherein the foot of the support deck is lower than the head of the support deck.

36. The patient support apparatus of claim 28, wherein the head frame further comprises a recumbent position with respect to the support deck.

37. The patient support apparatus of claim 36, wherein the head frame is pivotally coupled to the carriage with an actuator, the actuator pivoting the head frame between the recumbent position and the at least one inclined position.

38. The patient support apparatus of claim 28, further comprising a lift system coupled to the base frame and the support deck.

* * * * *